US011344468B2

(12) United States Patent
Davis et al.

(10) Patent No.: US 11,344,468 B2
(45) Date of Patent: May 31, 2022

(54) DEVICES, SYSTEMS AND METHODS FOR SELF-ADMINISTERED THERAPY

(71) Applicant: SENSUS HOLISTIC TECHNOLOGIES, LLC, Dallas, TX (US)

(72) Inventors: Douglas Bruce Davis, Dallas, TX (US); Brittney Richardson, Dallas, TX (US)

(73) Assignee: Sensus Holistic Technologies, LLC, Dallas, TX (US)

( * ) Notice: Subject to any disclaimer, the term of this patent is extended or adjusted under 35 U.S.C. 154(b) by 0 days.

(21) Appl. No.: 17/115,476

(22) Filed: Dec. 8, 2020

(65) Prior Publication Data

US 2021/0085555 A1 Mar. 25, 2021

Related U.S. Application Data

(63) Continuation of application No. PCT/US2019/036107, filed on Jun. 7, 2019.
(Continued)

(51) Int. Cl.
*A61H 15/00* (2006.01)
*A61H 23/00* (2006.01)

(52) U.S. Cl.
CPC ..... *A61H 15/00* (2013.01); *A61H 23/00* (2013.01); *A61H 2015/005* (2013.01);
(Continued)

(58) Field of Classification Search
CPC .. A61H 15/00; A61H 23/00; A61H 2201/013; A61H 2201/1685;
(Continued)

(56) References Cited

U.S. PATENT DOCUMENTS 7,087,004 B1 * 8/2006 Berke ..... A61H 7/002 482/132
7,645,248 B2 * 1/2010 Brown ..... A61H 15/00 601/122

(Continued)

FOREIGN PATENT DOCUMENTS

WO WO 2019/237033 12/2019

OTHER PUBLICATIONS

International Search Report and Written Opinion for PCT Application PCT/US2019/036107, dated Sep. 30, 2019, which is the related PCT application to the present application.

*Primary Examiner* — Samchuan C Yao
*Assistant Examiner* — Nathan M Le
(74) *Attorney, Agent, or Firm* — Knobbe, Martens, Olson & Bear, LLP

(57) ABSTRACT

According to some embodiments, a device configured for self-administered therapy comprises at least two base members, each base member configured to be secured to a surface for mounting the device of said surface, a shaft configured to secure to the at least two base members and extend between the at least two base members, and at least one therapy member configured to be secured relative to the shaft, wherein the at least one therapy member is configured to rotate relative to the shaft during use, wherein the at least one therapy member is configured to be contacted by a user and configured to rotate during use.

19 Claims, 30 Drawing Sheets

Related U.S. Application Data

(60) Provisional application No. 62/682,917, filed on Jun. 9, 2018.

(52) U.S. Cl.
CPC ..... *A61H 2015/0021* (2013.01); *A61H 2015/0035* (2013.01); *A61H 2201/013* (2013.01); *A61H 2201/0221* (2013.01); *A61H 2201/1685* (2013.01); *A61H 2201/5064* (2013.01); *A61H 2201/5071* (2013.01); *A61H 2201/5082* (2013.01)

(58) Field of Classification Search
CPC .... A61H 2201/0126; A61H 2201/1285; A61H 2201/0157; A61H 2201/5058; A61H 2015/0071; A61H 2009/0064
See application file for complete search history.

(56) References Cited

U.S. PATENT DOCUMENTS 9,320,675 B2 4/2016 Johnson
2009/0176635 A1* 7/2009 Brinson ..... A61H 7/001 482/141
2010/0049106 A1 2/2010 Gueret
2011/0114208 A1 5/2011 Newman et al.
2011/0313333 A1* 12/2011 Nicholson ..... A61H 15/0092 601/120
2013/0190664 A1* 7/2013 Johnson ..... A61H 15/0092 601/129
2014/0114208 A1 4/2014 Smith et al.
2014/0171279 A1 6/2014 Justice Velasco
2014/0350443 A1* 11/2014 Raines ..... A61H 15/0092 601/120
2015/0231016 A1* 8/2015 Stearns ..... A61H 7/001 601/136
2015/0245977 A1* 9/2015 Sungarian ..... A61H 15/00 601/118
2015/0257969 A1* 9/2015 Shannon ..... A61H 15/00 601/121
2015/0272774 A1* 10/2015 Lee ..... A61H 15/0092 601/15
2015/0328080 A1* 11/2015 Ryan ..... A61H 15/00 601/128
2016/0346162 A1* 12/2016 Powers ..... A61H 15/02
2017/0258671 A1 9/2017 Turner et al.
2017/0273859 A1* 9/2017 Slocum ..... A61H 15/00
2018/0103808 A1* 4/2018 Cheong ..... A61H 15/00
2018/0296430 A1* 10/2018 Bouch ..... A61H 15/00
2020/0306131 A1* 10/2020 Weinstein ..... A61H 1/00

* cited by examiner

DEVICES, SYSTEMS AND METHODS FOR SELF-ADMINISTERED THERAPY

CROSS-REFERENCE TO RELATED APPLICATIONS

This application is a continuation of PCT Application PCT/US2019/036107 filed Jun. 7, 2019, which claims priority to U.S. Provisional Application No. 62/682,917 filed Jun. 9, 2018. The contents of both of the foregoing are incorporated by reference herein in their entireties.

BACKGROUND

Field

This application relates generally to technologies for therapy, and more specifically, to devices, systems and methods to enhance and/or otherwise improve massage therapy, physical therapy and/or any other type of therapy that can be self-administered to a subject.

Description of the Related Art

Musculoskeletal research has over time identified a number of key myofascial trigger points (MTrP) on the human anatomy that cause pain (see, e.g., FIG. 1). Knowledge of where muscular pain or dysfunction originates in the body typically requires specialized training, and is the basis for the practice of therapeutic massage.

Therapeutic massage incorporates a variety of advanced modalities that enhance the body's natural restorative functioning. For instance, light to firm touch, determined, e.g., based upon the myofascial trigger point, can be used to release tension, relax muscles, increase blood and lymph circulation and imparts a sense of calm, among other benefits and advantages. Under certain circumstances, therapeutic massage can be used as a collaborative, supportive addition to conventional medical treatment of illness and injury, alleviating pain and stress, aiding soft tissue healing and revitalizing the body.

Unfortunately, massage therapy is seldom received as frequently as desired or needed for the relief of musculoskeletal pain. Cost, scheduling and other logistical challenges contribute to a need to provide some form of self-administered massage therapy. Athletes have especially driven the demand for commercial products that allow massaging of deep (or muscle) fascia, the dense fibrous connective tissue that penetrates and surrounds the muscles, bones, nerves and blood vessels of the body, among other targeted anatomical structures or areas. Many athletes and fitness enthusiasts include self-administered massage as part of their daily training or exercise regimen. Other population groups (e.g., sedentary workers, workers subjected to repetitive motion injuries, trauma patients, etc.) also suffer myofascial conditions that can benefit from self-administered massage therapy.

As a result, a proliferation of passive devices, such as foam rollers of various sizes and textures, has occurred to satisfy such self-therapy needs. Existing technologies for self-administered therapy, such as, e.g., use of foam rollers, include many drawbacks and limitations. For example, there exists the risk of potential mistreatment of pain resulting from a lack of knowledge of the myofascial trigger point(s) that are the pain's source. Further, existing solutions require a sense of balance beyond the capabilities of many aged and infirm users. Relatedly, such technologies require strength beyond the capacity of users that are more physically challenged.

Further, foam rolling and other existing methods of self-administered massage therapy pose limitations related to which of the MTrP can be effectively self-treated given anatomical location. In addition, they typically offer no objective feedback on their correct application and effect as therapy. Moreover, current solutions do not include data logging and/or processing (e.g., for historical review and trending for therapy evaluation and improvement).

Limitations of existing solutions of self-administered therapy, such as those discussed above, inhibit users from attaining some or all of the therapeutic benefits of massage or other desired therapy types. Accordingly, a strong need exists for more reliable, effective and lower costs technologies associated with self-administered massage and other anatomical therapy. Specifically, a need exists for a solution which includes attributes that facilitate more inclusive and therapeutically-beneficial engagement by users whose physical limitations and knowledge of MTrP prevent them from achieving the potential benefit of self-administered therapeutic massage. Additionally, monitoring and recording the use of the system can provide feedback to the user and therapist so compliance regarding treatment and recovery can be tracked, assessed and enhanced (e.g., optimized).

SUMMARY

According to some embodiments, a device configured for self-administered therapy comprises at least two base members, each base member configured to be secured to a surface for mounting the device of said surface, a shaft configured to secure to the at least two base members and extend between the at least two base members, and at least one therapy member configured to be secured relative to the shaft, wherein the at least one therapy member is configured to rotate relative to the shaft during use, wherein the at least one therapy member is configured to be contacted by a user and configured to rotate during use.

According to some embodiments, the at least two base members is configured to be releasably secured to a surface, wherein the at least one therapy member comprises an opening sized, shaped and configured to permit the shaft to pass therethrough, wherein an orientation of the device can be modified by changing a position of each of the at least two base members relative to a surface, wherein the device is configured to be disassembled such that the at least two base members, the shaft and the at least one therapy member can be separated relative to each other, and wherein the at least two base members are configured to be mounted on a flat surface, wherein the flat surface comprises a vertical surface, a horizontal surface or any other surface.

According to some embodiments, each of the at least two base members is configured to be releasably secured to a surface. In some embodiments, the at least one therapy member comprises an opening sized, shaped and configured to permit the shaft to pass therethrough. In certain arrangements, an orientation of the device can be modified by changing a position of each of the at least two base members relative to a surface.

According to some embodiments, the device is configured to be disassembled such that the at least two base members, the shaft and the at least one therapy member can be separated relative to each other. In some embodiments, the at least two base members are configured to be mounted on a flat surface, wherein the flat surface comprises a vertical surface, a horizontal surface or any other surface.

According to some embodiments, the at least one therapy member comprises a foam roller device. In some embodiments, the at least one therapy member comprises a ball or spherical shape. In some embodiments, the at least one therapy member comprises a wheel shape. In some embodiments, the at least one therapy member comprises a cylindrical shape. In certain arrangements, the at least one therapy member comprises another shape. In some arrangements, the at least one therapy member comprises one or more of the following shapes or configurations: star-shape, cammed shape, spring-shape, sprocket-shape, irregular shape or any other shape.

According to some embodiments, at least a portion of an outer surface of the at least one therapy member is smooth. In some arrangements, at least a portion of an outer surface of the at least one therapy member is not smooth. In one embodiment, the outer surface of the at least one therapy member comprises at least one protrusion, projection, undulation or other non-planar feature or configuration.

According to some embodiments, the at least one therapy member comprises at least two therapy members, wherein each of the at least two therapy members is configured to be secured to the shaft. In some embodiments, the at least two therapy members are configured to be moved separately from each other during use of the device.

According to some embodiments, the device further comprises at least one spacer, the at least one spacer being sized, shaped and otherwise configured to be secured to the shaft, wherein the at least one spacer is configured to provide a separation distance between the at least one therapy member and another portion or component of the device.

According to some embodiments, the at least one spacer is configured to provide a separation distance between the at least one therapy member and at least one of the at least two base members. In some embodiments, the at least one spacer comprises a first spacer and a second spacer, wherein the first spacer is configured to be positioned between the at least one therapy member and a first base member of the at least two base members, and wherein the second spacer is configured to be positioned between the at least one therapy member and a second base members of the at least two base members. In some embodiments, the at least one spacer is configured to center the at least one therapy member between the at least two base members. In certain arrangements, the at least one therapy member comprises two therapy members, and wherein the at least one space is configured to be positioned between the two therapy members to provide a separation distance between the two therapy members.

According to some embodiments, one or more of the following comprises a thermoplastic material: the at least two base members, the shaft and the at least one therapy member. In some embodiments, the at least one therapy member comprises a rigid or semi-rigid material. In some embodiments, the at least one therapy member is at least partially flexible in order to permit at least a portion of the at least one therapy member to at least partially deflect when contacted by a user.

According to some embodiments, the at least two base members are configured to secure to a surface using a suction-cup feature. In some embodiments, the suction-cup feature comprises a lever that is moved to move a portion of the suction-cup feature toward a surface in order to facilitate positive engagement between the at least two base members and a surface to which the device is secured.

According to some embodiments, the at least two base members are configured to secure to a surface using one or more of the following: bolts or other fasteners, clips, flanges, snap-on connections, friction or press-fit connections, adhesives, magnetic connections, hook and loop and any other release connection member or technology.

According to some embodiments, the at least two base members are configured to secure to a surface using a permanent or non-releasable connection. In some embodiments, the at least two base members are configured to withstand shear forces, torsional forces and any other forces or moments imparted on the device by an adult human using said device while still staying secured to a surface.

According to some embodiments, the shaft is cylindrical. In some arrangements, the shaft comprises a metal or an alloy. In some embodiments, the shaft comprises aluminum, stainless steel and/or another metal or alloy. In some embodiments, the shaft is at least partially hollow. In some embodiments, the shaft is at least partially solid. In some embodiments, the shaft is at least partially hollow.

According to some embodiments, the device further comprises at least one sensor. In some embodiments, the at least one sensor comprises one or more of the following: a pressure sensor, a proximity sensor, a location sensor, a strain sensor, a temperature sensor, a humidity sensor, an elevation sensor, a position sensor, a rotational sensor, a motion or movement sensor and any other type of sensor.

According to some embodiments, the at least one sensor is positioned one or near the at least one therapy member. In some embodiments, the at least one sensor is positioned one or near at least of the at least two base members. In some arrangements, the at least one sensor comprises at least one pressure sensor, the at least one pressure sensor being configured to ensure that a user is applying generally equal force along each of the at least two base member during use. In some arrangements, the at least one pressure sensor comprises at least one thin film pressure sensor. In one embodiment, the at least one thin film pressure is positioned on, along or near the at least two base members.

According to some embodiments, data obtained from the at least one sensor is configured to be communicated to at least one processor In certain arrangements, the at least one processor is configured to process said data obtained from the at least one sensor and provide feedback to a user. In some embodiments, the at least one processor is part of a tablet, a smartphone, a personal computer or any other computing device. In some embodiments, the tablet, smartphone, personal computer or other computing device is configured to provide feedback to a user of the device.

According to some embodiments, a method of self-administered therapy comprises positioning a device according to one or more of the embodiments disclosed herein, wherein the method further includes performing a therapy procedure using said device.

According to some embodiments, the surface on which a therapy device is configured to be secured comprises a wall, a floor or any other surface. In some embodiments, the device is positioned in a horizontal, a vertical or a diagonal orientation. In some embodiments, the method further includes moving the device to a different orientation by repositioning at least one of the at least two base members of the device along a surface.

According to some embodiments, a method additionally includes providing at least one input from a user of the device using an input. In some arrangements, the at least one input comprises one or more of the following: an indication, a symptom, an anatomical region to be targeted and a desired treatment result. In some embodiments, the input comprises at least one of the following: a tablet, a smartphone, a touchscreen, a keyboard and any other tactile-enabled electronic device.

According to some embodiments, the indication or symptom includes an indication or symptom associated with musculoskeletal pain or discomfort. In some embodiments, the method additionally includes providing an output to the user, wherein the output is related to the recommended therapy protocol. In some embodiments, the recommended therapy protocol comprises a protocol for physical therapy.

According to some embodiments, the output to the user comprises a display or other visual output. In some arrangements, the display is part of a tablet, a smartphone or other computing device. In some embodiments, the display is included as part of the at least one input device. In some arrangements, the output to the user comprises an audible output.

According to some embodiments, a kit or system comprises a device according to one or more of the embodiments disclosed herein, wherein the at least one therapy member of the device comprises at least two therapy members.

According to some embodiments, the at least two therapy members are identical. In some embodiments, a first therapy member and a second therapy member of at least two therapy members each comprises a spherical member. In certain arrangements, the first therapy member and the second therapy member are configured to be immediately adjacent one another when the device is assembled.

According to some embodiments, the first therapy member and the second therapy member are configured to be separated from one another when the device is assembled, wherein the first and second therapy members are configured to be separated using at least one spacer. In some embodiments, the kit or system comprises at least one spacer. In some embodiments, the at least one spacer comprises two or more spacers. In some embodiments, the two or more spacers are identical. In other arrangements, the two or more spacers are different.

According to some embodiments, the at least two therapy members are different. In some embodiments, a first therapy member of the at least two therapy members comprises a spherical member, and wherein a second therapy member of at least two therapy members comprises a cylindrical member. In some arrangements, the shaft comprises a first shaft and at least a second shaft, wherein the at least a second shaft comprises a different length than the first shaft.

According to some embodiments, a method of self-administered therapy (e.g., massage therapy, physical therapy, other types of therapy, etc.) includes receiving at least one input from a user using at least one input device, the at least one input relating to at least one of the following: an indication, a symptom, an anatomical region to be targeted and a desired treatment result, processing the at least one input using a processor to determine a recommended therapy protocol and providing an output to the user, the output related to the recommended therapy protocol.

According to some embodiments, the input device comprises a tablet, a smartphone, a touchscreen, a keyboard, another tactile-enabled electronic device and/or any other computing device or component. In some embodiments, the indication or symptom includes an indication or symptom associated with musculoskeletal pain or discomfort.

According to some embodiments, the recommended therapy protocol comprises a protocol for massage therapy. In some arrangements, the recommended therapy protocol comprises a protocol for physical therapy.

According to some embodiments, the output to the user comprises a display or other visual output (e.g., monitor). In some embodiments, the display is part of a tablet, a smartphone or other computing device. In some arrangements, the display is included as part of the at least one input device. In one embodiment, the output to the user comprises an audible output (e.g., via a speaker).

According to some embodiments, the processor is included as part of the at least one input device. In some embodiments, the processor is separate from the at least one input device (e.g., included in a separate device or component, its own separate housing or enclosure, etc.).

According to some embodiments, the method further includes receiving at least one sensor signal from at least one sensor. In some embodiments, the at least one sensor signal comprises a signal received from at least one of the following types of sensors: a pressure sensor, a proximity sensor, a location sensor, a strain sensor, a temperature sensor, a humidity sensor, a motion or movement sensor, rotational sensor, sensors used in electrodiagnosis (EDX) such as electromyography (EMG) and any other type of sensor.

According to some embodiments, the at least one sensor signal is received from at least one sensor positioned on a device that contacts the user and in connection with which the recommended therapy protocol is at least partially conducted. In some embodiments, the at least one sensor signal is received from at least one sensor that is secured to the user (e.g., the sensor is secured to and/or included on, in or near a wristwatch, a wristband, a band or other device worn across the chest and/or the like).

According to some embodiments, the at least one sensor signal is transmitted to the processor using a wireless connection (e.g., Wi-Fi, Bluetooth, any other type of wireless connection platform, etc.). In other embodiments, the at least one sensor signal is transmitted to the processor using a physical connection (e.g., hardwired connection via a cable). In one embodiment, the physical connection comprises a ported connection or a hardwired connection.

According to some embodiments, the recommended therapy protocol comprises step-by-step instructions that are configured to be followed by the user in real-time. In some embodiments, wherein a computer-readable medium is in communication with the processor and configured to execute a set of instructions to determine the recommended therapy protocol. In some embodiments, the computer-readable medium is included as an application or other executable program for a tablet or smartphone. In certain arrangements, the computer-readable medium is included as software in a computing device.

According to some embodiments, a system for assisting a user to perform self-administered therapy, wherein the system comprises a therapy device, the therapy device configured to contact the user's body during a therapy protocol, a mounting device configured to support the therapy device, and a user interface, the user interface configured to receive at least one input from the user, wherein the user interface is further configured to provide an output to the user, the output related to a recommended therapy protocol.

According to some embodiments, the therapy device is configured to provide massage therapy to the user. In some arrangements, the therapy device is configured to provide physical therapy to the user.

According to some embodiments, the therapy device comprises one or more of the following shapes: a sphere, a hemisphere or other partial sphere, a cylinder, a polygon, a torus, a helix, an irregular shape and any other shape.

According to some embodiments, the therapy device comprises one or more natural materials. In some arrangements, the therapy device comprises one or more synthetic materials. In some arrangements, the therapy device comprises one or more of the following materials: a cork, a polymeric material, a rubber or other elastomeric material, a wood, a metal, an alloy and/or the like. In some embodiments, the therapy device comprises one or more of the following materials: synthetic cork, polypropylene and ethylene vinyl acetate. In some embodiments, at least a portion of the therapy device that is configured to contact the user is configured to include physical characteristics that at least partially mimic physical characteristics of human skin.

According to some embodiments, at least a portion of the therapy device is configured to be selectively heated or cooled (e.g., using thermoelectric devices, other heating or cooling technologies, etc.). According to some embodiments, at least a portion of the therapy device is configured to be selectively vibrated or otherwise moved according to a desired frequency or pattern. In some embodiments, the therapy device comprises a battery or other power storage and/or power supply device.

According to some embodiments, the mounting device or structure is configured to be removably secured to a surface. In some embodiments, the mounting device or structure is configured to be permanently secured to a surface. In some arrangements, the mounting device or structure is configured to be secured to a wall, a floor and/or any other planar or generally planar surface. In some embodiments, the mounting device or structure is configured to be secured to a piece of equipment or another device.

According to some embodiments, the mounting device is configured to be removably secured to the therapy device. In some embodiments, the mounting device is configured to receive two or more different configurations of the therapy device. In some embodiments, the mounting device is configured to be permanently secured to the therapy device.

According to some embodiments, the therapy device comprises at least one sensor, the at least one sensor being configured to provide at least one sensor signal to a processor. In some embodiments, the at least one sensor comprises one or more of the following: a pressure sensor, a proximity sensor, a location sensor, a strain sensor, a temperature sensor, a humidity sensor, a motion or movement sensor and any other type of sensor.

According to some embodiments, the system comprises at least one input device and a processor. In some embodiments, the at least one input device is configured to permit the user to provide at least one input relating to at least one of the following: an indication, a symptom, an anatomical region to be targeted, a desired treatment result and/or the like.

According to some embodiments, the indication or symptom includes an indication or symptom associated with musculoskeletal pain or discomfort. In some embodiments, the processor is configured to determine a recommended therapy protocol.

According to some embodiments, the system further comprises an output device, wherein the output device is configured to provide an output to the user, the output related to a recommended therapy protocol. In some embodiments, the input device comprises at least one of the following: a tablet, a smartphone, a touchscreen, a keyboard, any other tactile-enabled electronic device and/or the like. In some embodiments, the output from the output device to the user comprises a display or other visual output.

According to some embodiments, the display is part of a tablet, a smartphone or other computing device. In one embodiment, the display is included as part of at least one input device. In some embodiments, the processor is included as part of the at least one input device. In some embodiments, the processor is separate from the at least one input device.

According to some embodiments, various devices, systems and methods for self-administered therapy (e.g., massage therapy, physical therapy, etc.) disclosed herein include one or more mounting carriages that facilitate optimized or enhanced presentation of various massage devices in accordance with one or more anatomical objectives of the corresponding (e.g., targeted) therapy.

According to some embodiments, various devices, systems and methods for self-administered therapy (e.g., massage therapy, physical therapy, etc.) disclosed herein are configured to be placed on the mounting carriage or other mounting device or assembly. In some embodiments, the mounting carriage or other mounting device is configured to enhance or optimize the targeting (e.g., via massage or other therapy) specific points on the body of a user (e.g., to relieve musculoskeletal tension and/or pain, to provide other type of benefit, etc.). In some embodiments, the shape, density, mobility and/or other characteristics, properties and/or parameters of the various components of the therapy system are configured to enhance (e.g., optimize) the effects of massage or other therapy.

According to some embodiments, the various arrangements disclosed herein include systems and devices that aid users in determining an effective massage or other type of therapy protocol for indicated symptoms of musculoskeletal pain or discomfort, system and devices to implement a desired treatment protocol, systems and device that facilitate data generation and analysis capability to provide feedback to the user regarding proper execution of the treatment protocol and historical usage information and/or the like. Methods related to such systems and devices are also disclosed.

According to some embodiments, the system comprises software, algorithms and/or other code that are configured to operate on a tablet, smartphone or other computing device. In some embodiments, such arrangements are configured to receive information directly or indirectly from the user, create one or more appropriate therapy (e.g., massage therapy, physical therapy, etc.) treatment protocols, monitor and provide feedback to the user as therapies are executed and followed and/or the like. In some embodiments, the software is configured to archive or otherwise save or memorialize the usage for later review and/or analysis by the user or another individual or system.

According to some embodiments, the systems and devices disclose herein further include a mounting carriage or other support device for interchangeable massage devices that itself can be easily and securely fastened (e.g., permanently or temporarily) on one or more desired (e.g., vertical and horizontal) surfaces. In some embodiments, once fastened or otherwise placed on or secured to a surface, the mounting carriage provides a platform that positions (e.g., astronomically optimizes or enhances, etc.) a device or component for therapy (e.g., massage therapy, physical therapy, etc.) to the user to administer a desired therapy protocol. In some arrangements, the systems and devices disclosed herein comprise sensor-based data collection capability and analysis for monitoring use of the system.

According to some embodiments, when a therapy system or device is in use, signals from one or more sensors (e.g., embedded sensors, sensors worn by a user regardless of whether they are incorporated into the therapy system or device, etc.) are collected by a processing module (e.g., a microprocessor). Such a module can be located in the mounting carriage or any other component of the system. In some embodiments, the processing module is separate of the system or device components (e.g., included as part of a separate computing device, such as a tablet, a smartphone, personal computer, computer network, etc.). Regardless of the exact location, configuration and other details of the processor, signals from one or more sensors and/or any other inputs (e.g., data input by the user via one or more input devices, such as, for instance, a tablet or smartphone touch-screen, a keyboard, etc.) can be processed and analyzed. Thus, in some embodiments, the user or another interested individual (e.g., a massage therapist, another type of therapist, a physician or other practitioner, etc.) is provided desired information (e.g., confirmation that the therapy protocol is being properly followed).

According to some arrangements, the system includes multiple embodiments of massage or other therapy devices that may be interchanged with the mounting carriage. The embodiments of these devices can vary in shape, size, material and/or in any other way. In some embodiments, various therapy devices that can be selectively secured to the mounting carriage or other support member can be optimized or otherwise designed to perform a specific task (e.g., place pressure or otherwise target a particular muscle or anatomical area).

According to some embodiments, the various configurations disclosed herein include one or more sensors (e.g., embedded), accompanying electronics (e.g., circuitry), communications technologies and/or the like that facilitate detect and convey performance data generated when the system is in use. In some embodiments, the various arrangements disclosed herein include a computational device that can receive and process data streams from such sensor devices.

According to some embodiments, the systems disclosed herein comprise software and/or a processor that can enable a user to receive guidance regarding selection and to help operate the appropriate device(s) for treatment of physiological conditions such as soft tissue adhesion and inflammation that result in tension and pain on the user's body and/or other desired therapy. Software can be incorporated into the system or can be located in a separate device or system (e.g., computing device, tablet, smartphone, etc.), as desired or required.

According to some embodiments, the various arrangements disclosed herein include user-worn devices (e.g., sensors, sensor-enabled devices, etc.) that can detect, monitor and report data and other information (e.g., the position of the user's anatomical extremities during a meaningful period of time, EDX signals, other signals, other information, etc.) as an aid to diagnosing and treating musculoskeletal discomfort and/or otherwise facilitating the user with self-administered therapy.

According to some embodiments, the various arrangements disclosed herein include software or other executable code that can operate on the computational device during a self-administered therapy session or other procedure. In some embodiments, this can advantageously permit the system to provide feedback to the user regarding one or more aspects of a self-administered procedure (e.g., correct therapeutic application of the device/system).

Any methods described herein may be embodied in, and partially or fully automated via, software code modules executed by one or more processors or other computing devices. The methods may be executed on the computing devices in response to execution of software instructions or other executable code read from a tangible computer readable medium. A tangible computer readable medium is a data storage device that can store data that is readable by a computer system or other computing device (e.g., smartphone, tablet, etc.). Examples of computer readable mediums include read-only memory, random-access memory, other volatile or non-volatile memory devices, CD-ROMs, magnetic tape, flash drives, and optical data storage devices.

In addition, embodiments may be implemented as computer-executable instructions stored in one or more tangible computer storage media. As will be appreciated by a person of ordinary skill in the art, such computer-executable instructions stored in tangible computer storage media define specific functions to be performed by computer hardware such as computer processors. In general and by way of example, in such an implementation, the computer-executable instructions are loaded into memory accessible by at least one computer processor. The at least one computer processor can then execute the instructions, causing computer hardware to perform the specific functions defined by the computer-executable instructions. Computer execution of computer-executable instructions can be equivalent to the performance of the same functions by electronic hardware that includes hardware circuits that are hardwired to perform the specific functions. As such, while embodiments described herein are typically implemented as some combination of computer hardware and computer-executable instructions, the embodiments illustrated herein could also be implemented as one or more electronic circuits hardwired to perform the specific functions disclosed herein.

According to some embodiments, the various arrangements disclosed herein include software on the computational device to store, transmit and/or display data and/or other information collected during operation for historical analysis and purposes, such as, for example, compliance monitoring by third parties such as clinicians, therapists, and insurance companies.

BRIEF DESCRIPTION OF THE DRAWINGS

These and other features, aspects and advantages of the present application are described with reference to drawings of certain embodiments, which are intended to illustrate, but not to limit, the present disclosure. It is to be understood that the attached drawings are for the purpose of illustrating concepts disclosed in the present application and may not be to scale.

DETAILED DESCRIPTION

According to some embodiments, various devices, systems and methods for self-administered therapy (e.g., massage therapy, physical therapy, etc.) disclosed herein include one or more mounting carriages that facilitate optimized or enhanced presentation of various massage devices in accordance with one or more anatomical objectives of the corresponding (e.g., targeted) therapy.

According to some embodiments, various devices, systems and methods for self-administered therapy (e.g., massage therapy, physical therapy, etc.) disclosed herein are configured to be placed on the mounting carriage or other mounting device or assembly. In some embodiments, the mounting carriage or other mounting device is configured to enhance or optimize the targeting (e.g., via massage or other therapy) specific points on the body of a user (e.g., to relieve musculoskeletal tension and/or pain, to provide other type of benefit, etc.). In some embodiments, the shape, density, mobility and/or other characteristics, properties and/or parameters of the various components of the therapy system are configured to enhance (e.g., optimize) the effects of massage or other therapy.

According to some embodiments, the various arrangements disclosed herein include systems and devices that aid users in determining an effective massage or other type of therapy protocol for indicated symptoms of musculoskeletal pain or discomfort, system and devices to implement a desired treatment protocol, systems and device that facilitate data generation and analysis capability to provide feedback to the user regarding proper execution of the treatment protocol and historical usage information and/or the like. Methods related to such systems and devices are also disclosed.

As discussed in greater detail herein, the various embodiments disclosed herein facilitate allowing a user to provide one or more inputs via a tablet, smartphone and/or other computing device relating to a desired therapy (e.g., massage therapy). The system can advantageously receive such input from the user and provide specific guidance for conducting a targeted therapy protocol. As also discussed in greater detail herein, the configurations of the self-administered solutions described herein can incorporate one or more several device or components, including, without limitation, devices that are configured to contact the user (e.g., the therapy devices), devices or components that facilitate positioning and/or supporting the therapy devices, applications or other software components, user input, display and/or other user-interface devices (e.g., tablet or smartphone applications, computer software, dedicated tablets or similar devices, etc.), instruction manual and/or the like.

Figure 1:
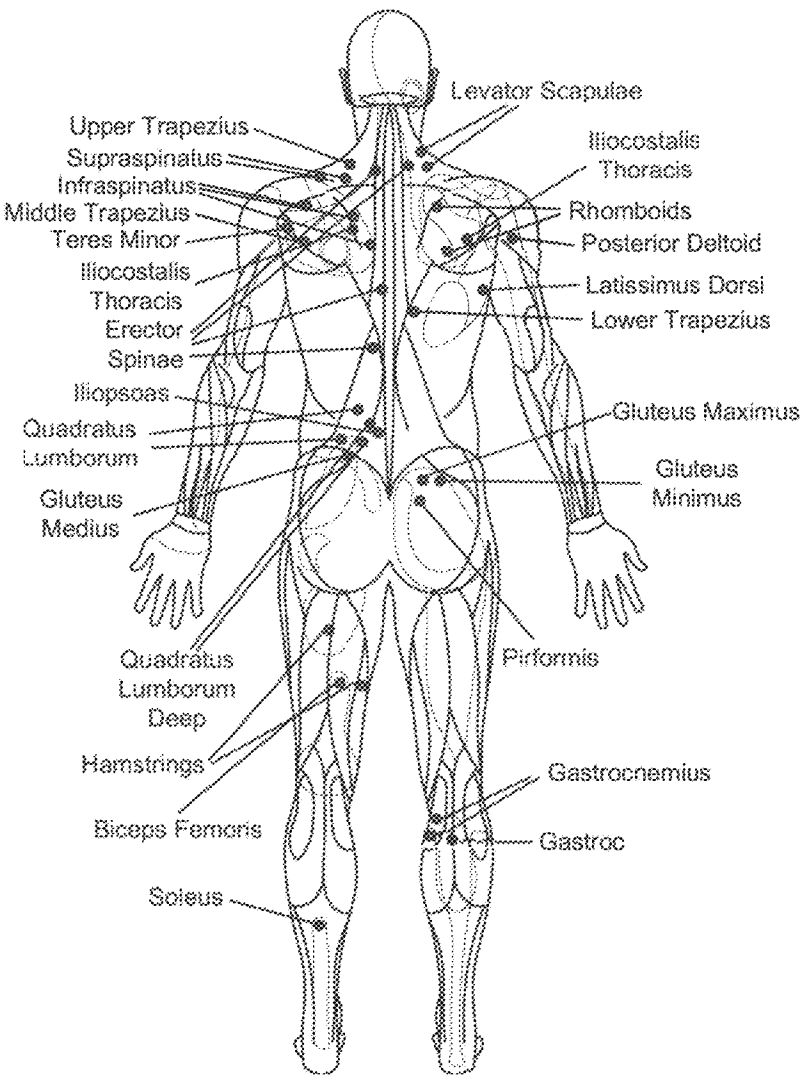
FIG. 1 illustrates one configuration of a myofascial trigger point map.
Figure 1:
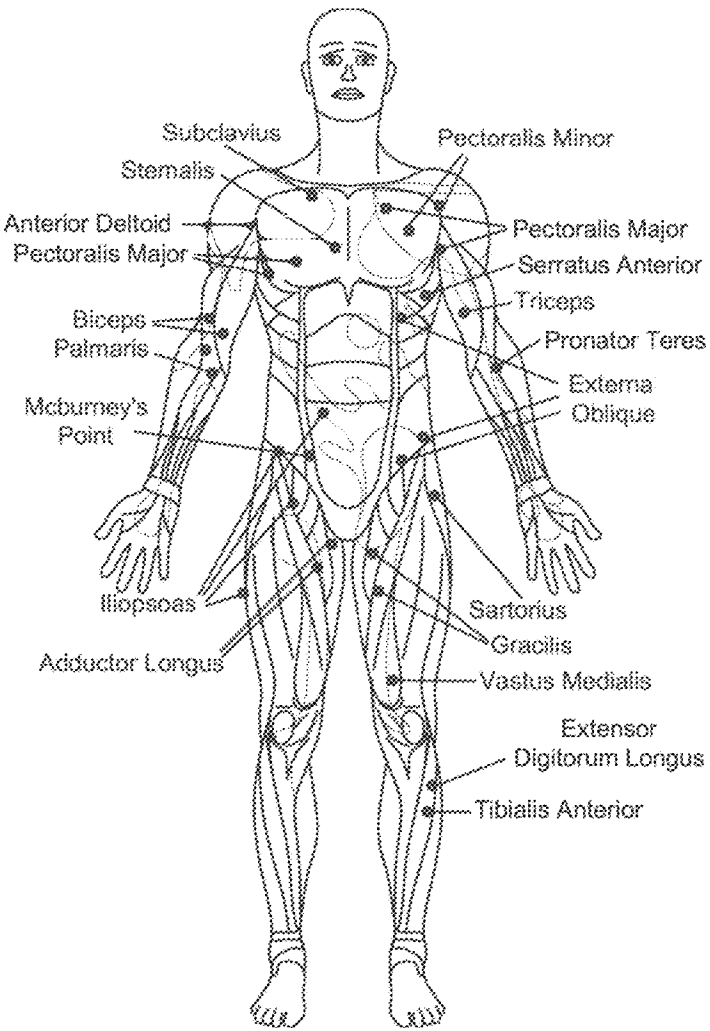
Figure 2:
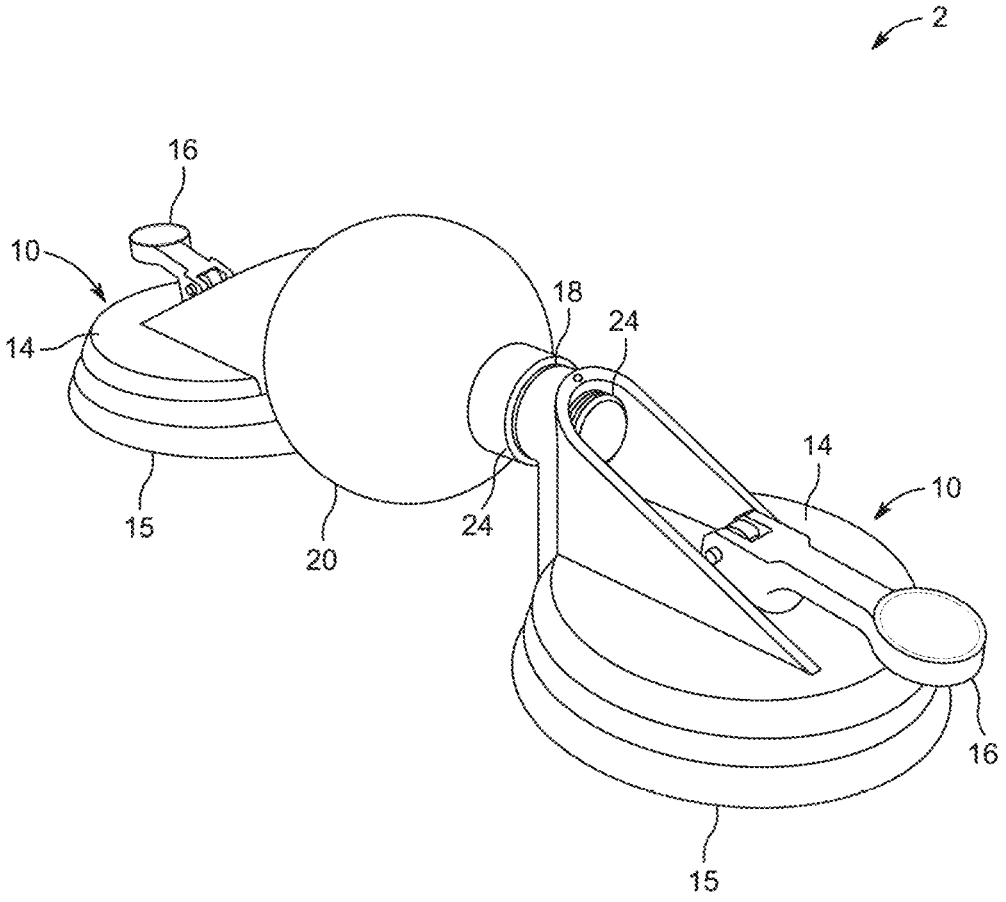
FIG. 2 illustrates a perspective view of one embodiment of a therapy device.

FIG. 2 illustrates one embodiment of an assembled massage or therapy device 2, including two mounting carriages or support members 10, a massage or therapy device (having a therapy assembly 20 and two tube members 24 extending from the therapy assembly). As illustrated in FIG. 2, the outer diameter of the shaft or extension member 18 of the support member is smaller than the inner diameter of the corresponding tube member 24 in order to permit a connection (e.g., friction fit, press-fit, threaded connection, etc.) between the two (e.g., allowing one component to turn or move relative to other when the user applies tangential force). In one arrangement, the resistance to the tube member's rotation is adjustable by a coupling between the shaft 18 and tube member 24 that can be adjusted to increase or decrease the friction created by the movement of the sleeve over the stationary tube member. As noted herein, each mounting carriage may be fixed to a surface using suction system including a pliable diaphragm 15, that when raised by depressing the locking tab 16 creates a vacuum that binds the mounting carriage to the surface. In other embodiments, the mounting carriage can be permanently or semi-permanently attached to a surface using hardware fasteners.

Figure 3A:
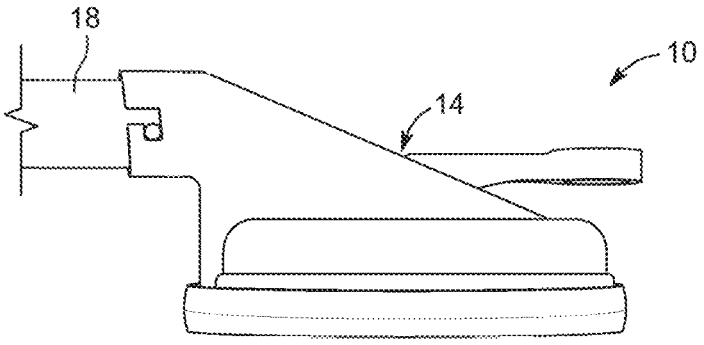
FIG. 3A illustrates a side view of a support member for a therapy device according to one embodiment.
Figure 3B:
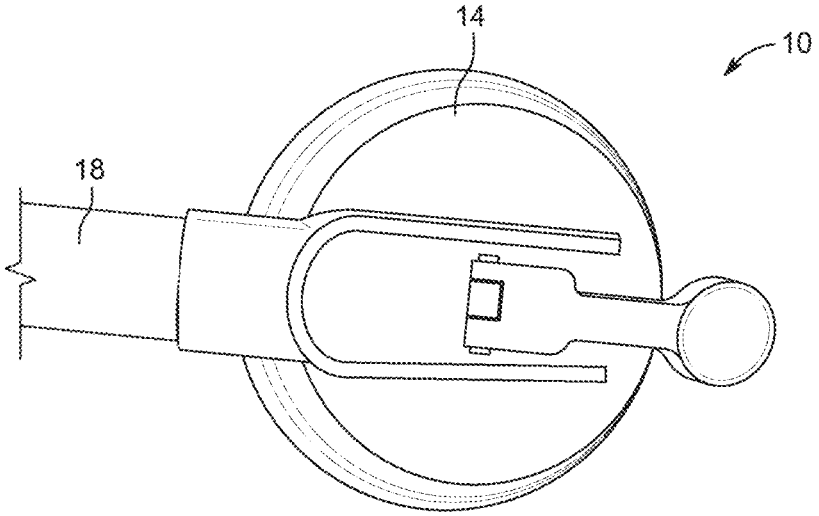
FIG. 3B illustrates a top view of the support member of FIG. 3A.
Figure 3C:
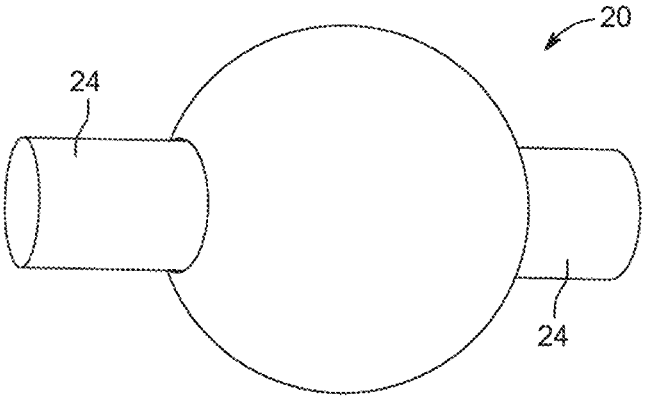
FIG. 3C illustrates a side view of a therapy device having a therapy assembly and a support structure according to one embodiment.

FIGS. 3A, 3B and 3C illustrate various embodiments of massage or other therapy device (together with any associated mounting carriage or other support device) that the system can instruct the user to use during the execution of a massage or other therapy protocol. Such devices can be provided by the same entity that supplies other components of the system (e.g., the executable application and/or other software, the processor other hardware and/or the like. Alternatively, one or more massage or other therapy devices can be supplied by third parties and be incorporated into a particular procedure or protocol (e.g., either as-is or in some modified form), as desired or required by a particular application or use.

With reference to FIGS. 3A, 3B and 3C, the mounting carriage or support member 10 can include one or more base 14 that are configured to contact (and, in some arrangements, secure to a mounting surface). Connected or coupled to and projecting from the mounting base 14 can be a shaft 18 or other extension member. In some embodiments, the shaft 18 is removable. In some embodiments, the shaft 18 is provided in various selectable lengths, such that the distance from the base 14 to the massage or other therapy device (FIG. 3C) can be customized. In some arrangements, the shaft 18 can include a telescoping design to permit a user to easily modify its length (either according to certain preselected lengths or to a very specific length as chosen by the user). Further, the shaft 18 can be configured such that it can be selectively angled or bent to accommodate for greater user flexibility.

In some embodiments, the shaft 18 comprises one or more polymeric materials that have favorable wear-resistant and/or low friction properties, such as, for example, polyoxymethylene. In other arrangements, the shaft 18 comprises one or more other materials, either in lieu of or in addition to polymeric materials, such as and without limitation, metals, alloys, elastomeric material, leather, wood, paper-based materials, other natural or synthetic materials and/or the like, as desired or required. By way of example, in one embodiment, the shaft 18 includes anodized or otherwise finished aluminum tubing.

According to some embodiments, the shaft 18 of the support member 10 is secured (e.g., directly or indirectly (e.g., via one or more intermediate members)) to the base using a connection such as a threaded coupling, a telescoping tube clamp, a bayonet fitting (see, e.g., FIG. 3A), another type of mechanical connection (e.g., flanged, snap-type, etc.), friction fit connection and/or the like to allow the shaft to be easily engaged or disengaged with the base 14. If more than one base component is included in the assembly, the shaft may be joined with each additional based using any type of connection (e.g., including, but not limited to, a relatively simple friction fit connection).

In some embodiments, the shaft or other extension member 18 is hollow or at least partially hollow. In other embodiments, however, the shaft is semi-hollow (e.g., more solid than hollow when comparing surface area across a cross-section of the shaft 18) or completely solid. The shaft 18 can include any desired cross-sectional shape, including, but not limited to, circular, partially-circular, oval, square or other rectangular, other polygonal, irregular and/or the like. The diameter or other cross-sectional dimension of the shaft 18 can vary, as needed or desired. For example, in some embodiments, the diameter or other cross-sectional dimension of the shaft 18 is 0.5 inches to 4 inches (e.g., 0.5-1, 1-2, 2-3, 3-4 inches, lengths within the foregoing ranges, greater than 4 inches, etc.). In other configurations, the diameter or other cross-sectional dimension of the shaft 18 is less than 0.5 inches.

In some embodiments, the length of the shaft or other extension member 18 of the support member 10 is 4 to 36 inches (e.g., 6-24, 8-20, 4-12, 4-6, 6-8, 8-10, 10-12, 12-14, 14-16, 16-18, 18-20, 20-24, 24-28, 28-32, 32-36 inches, lengths between the foregoing ranges, etc.). In other arrangements, the length of the shaft 18 is less than 4 inches or greater than 36 inches, as desired or required. As noted herein, the shaft can be configured such that its length is selectively adjustable by a user. In some embodiments, the shaft 18 comprises a telescoping structure or a tripod-leg type adjustable mechanism.

The base 14 of the support member or mounting carriage 10 can be configured to secure to a wall, floor and/or any other surface using one or more connection devices, features and/or methods. For instance, in some embodiments, the base 14 can be adapted to secure to a surface using a releasable connection, such as, for example, a suction cup design. In other embodiments, the system comprises one or more surface securement plates or other devices (not shown) that are configured to permanently or removably attach to a wall or a floor. In such arrangements, the base 14 can be configured to removably or permanently couple to the securement plate(s), using one or more type of attachment devices, feature or methods (e.g., bolts or other fasteners, clips, flanges, snap-on connections, friction or press-fit connections, adhesives, magnetic connections, etc.). Thus, in such a configuration, the base 14 can be, in certain removable embodiments, switched, with relative ease and speed, between different securement plates that are situated within a particular room, area or facility.

Additional embodiments of therapy devices, systems and/or kits are illustrated in FIGS. 4 to 14C and discussed in greater detail herein.

Figure 4:
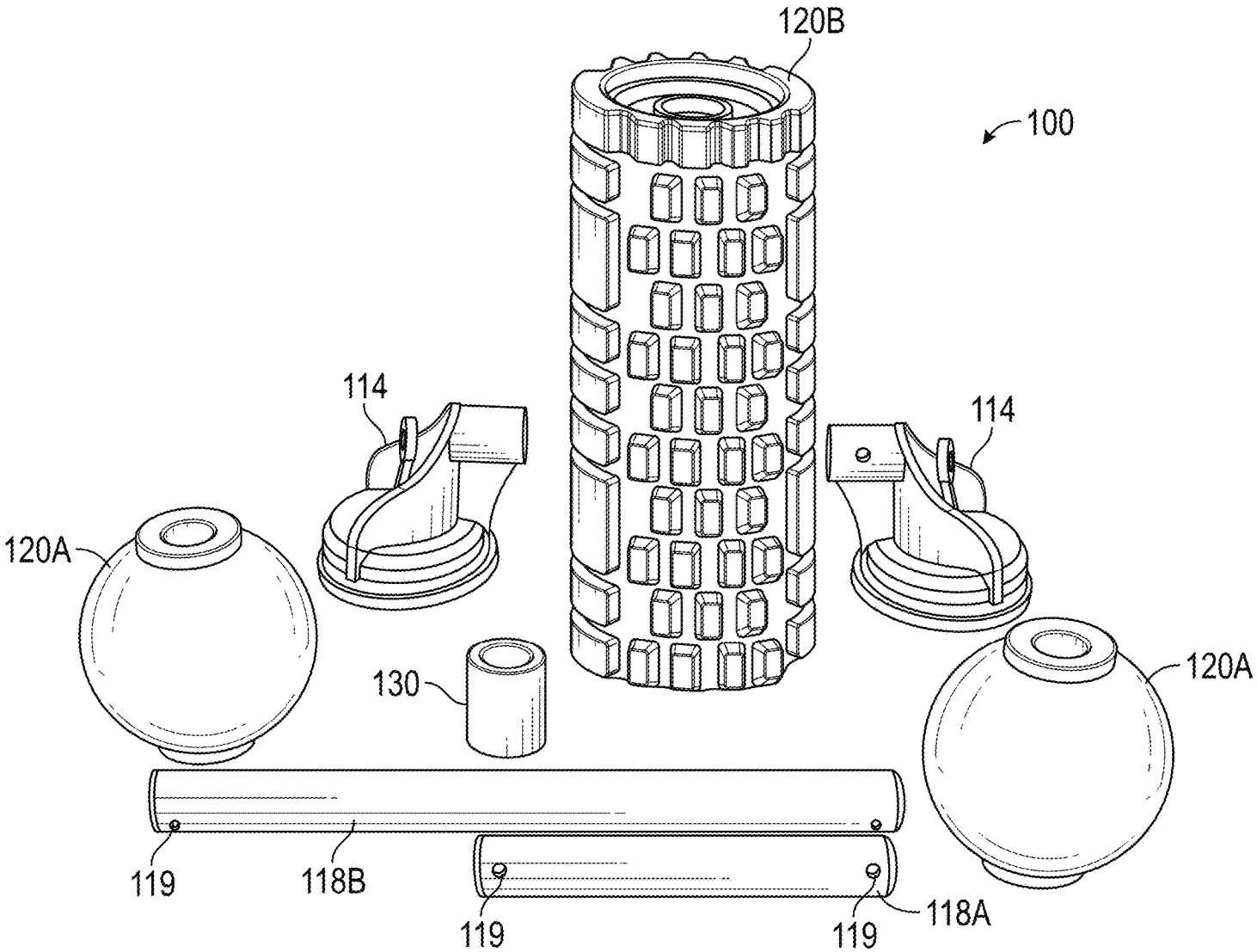
FIGS. 4 to 7B illustrate various configurations of a kit that includes components for customizing a therapy device according to one embodiment.

For example, FIGS. 4 to 7B illustrate an embodiment of a therapy system 100 that allows a user to customize the devices and components provided therewith to achieve a desired or required protocol. In some embodiments, as shown in FIG. 4, the therapy system or kit 100 is modular to permit customization of the configuration of the resulting therapy device. In some arrangements, the system or kit 100 includes two or more (e.g., 2, 3, 4, more than 4, etc.) base members 114, one or more (e.g., 1, 2, 3, 4, more than 4, etc.) shafts 118A, 118B, one or more (e.g., 1, 2, 3, 4, more than 4, etc.) therapy devices 120A, 120B, one or more spacers (e.g., 1, 2, 3, 4, more than 4, etc.) 130 and/or any other component or device.

Figure 5:
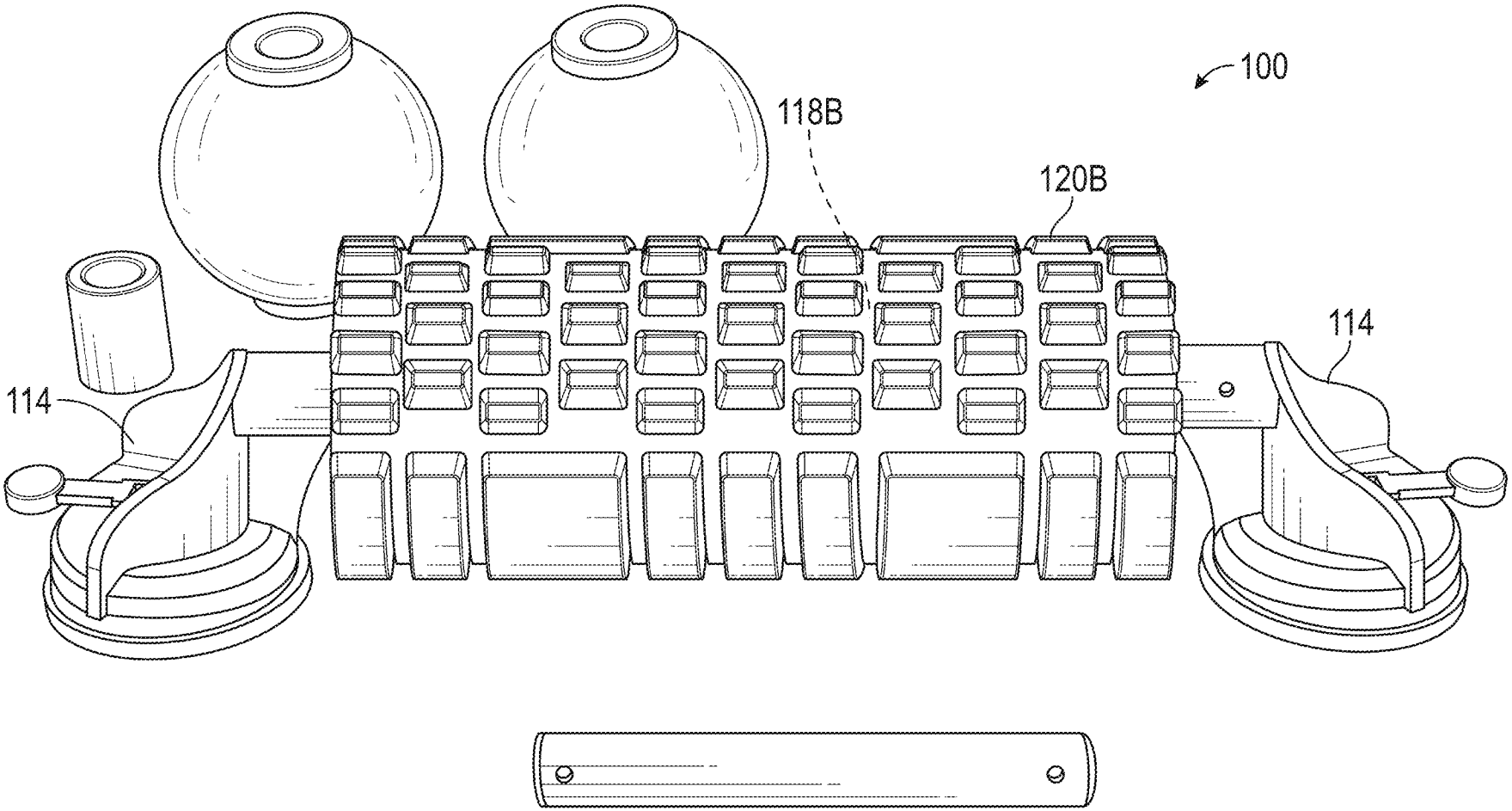

With reference to FIG. 5, by way of example, the therapy system 100 has been assembled to include a larger, cylindrically shaped therapy member 120B. In some embodiments, the longer shaft 118B (not shown in FIG. 5) has been positioned within a corresponding internal opening of the cylindrical therapy member 120B and has been secured to each of the base members 114. Therefore, in such a configuration, certain components of the system (e.g., the spherical or ball-shaped therapy members 120A, the shorter shaft 118A and the spacer 130 have not been used in the assembly.

Figure 6:
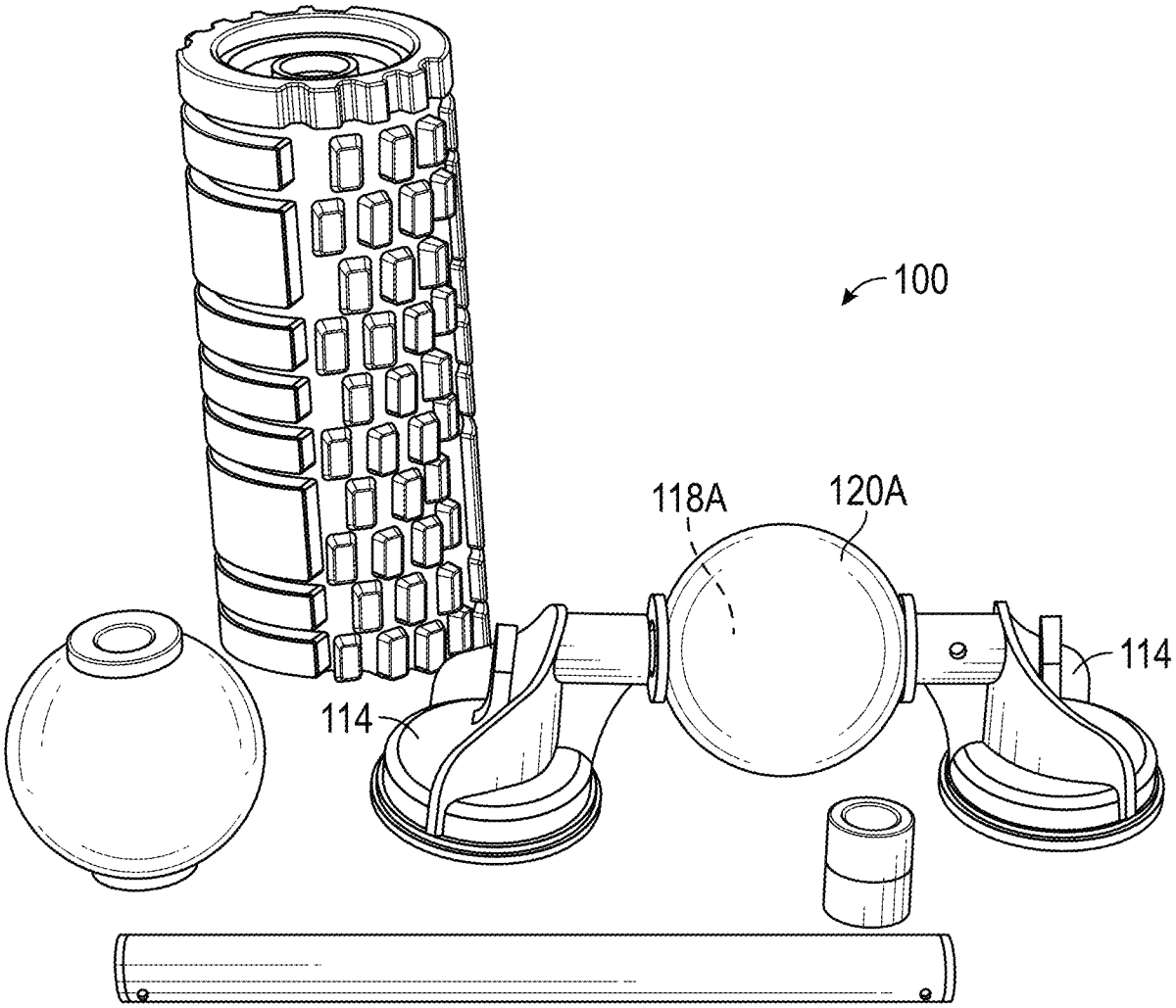

As illustrated in FIG. 6, a user can easily reconfigure the therapy system or kit 100 so that the resulting assembly includes only a single spherical therapy member 118A. In such an embodiment, the shorter shaft 118A has been positioned through a central opening of the therapy member 118A and secured to the base members.

Figure 7A:
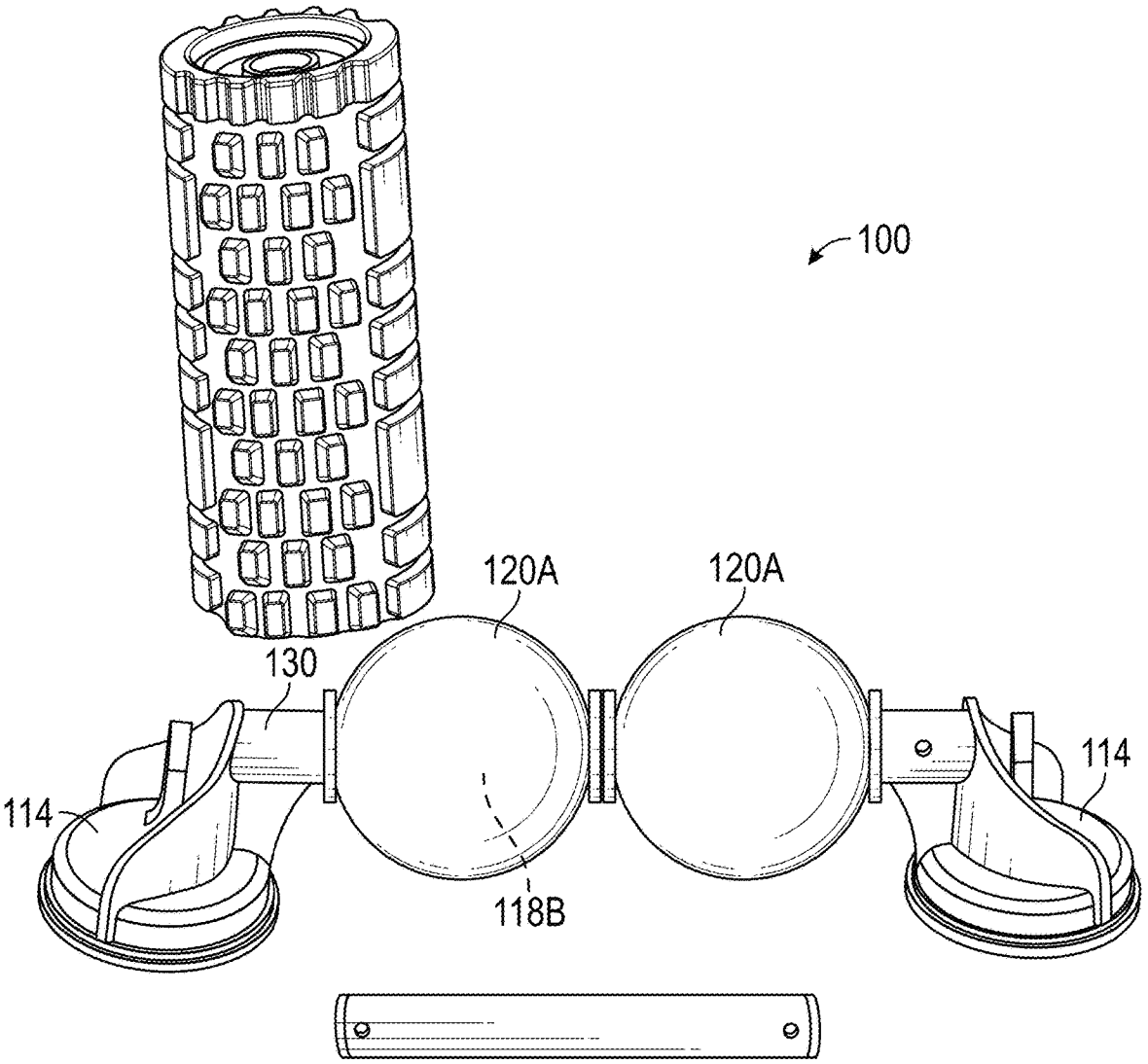

In the arrangement illustrated in FIG. 7A, both spherically shaped therapy members 120A have been used. The longer shaft 118A (not shown in FIG. 7A, as it is hidden within the interior openings of the therapy members 120A) can be used. The shaft 118A is positioned through the openings of the therapy members 120A, and each of the ends of the shaft 118A is connected to one of the base members 114. As illustrated in FIG. 7A, the spacer 130 can be used to provide a desired spacing between one or more of the therapy member 120A relative to another portion of the assembled device. For instance, in the depicted embodiment, the spacer 130 is positioned around the shaft, between the left therapy member 120A and left base member 114. This creates a non-symmetrical orientation of the therapy members 120A, and thus the entire assembly. However, in other embodiments, the quantity, size (e.g., length), location and/or other details of any spacer(s) can be modified to create a different configuration.

Figure 7B:
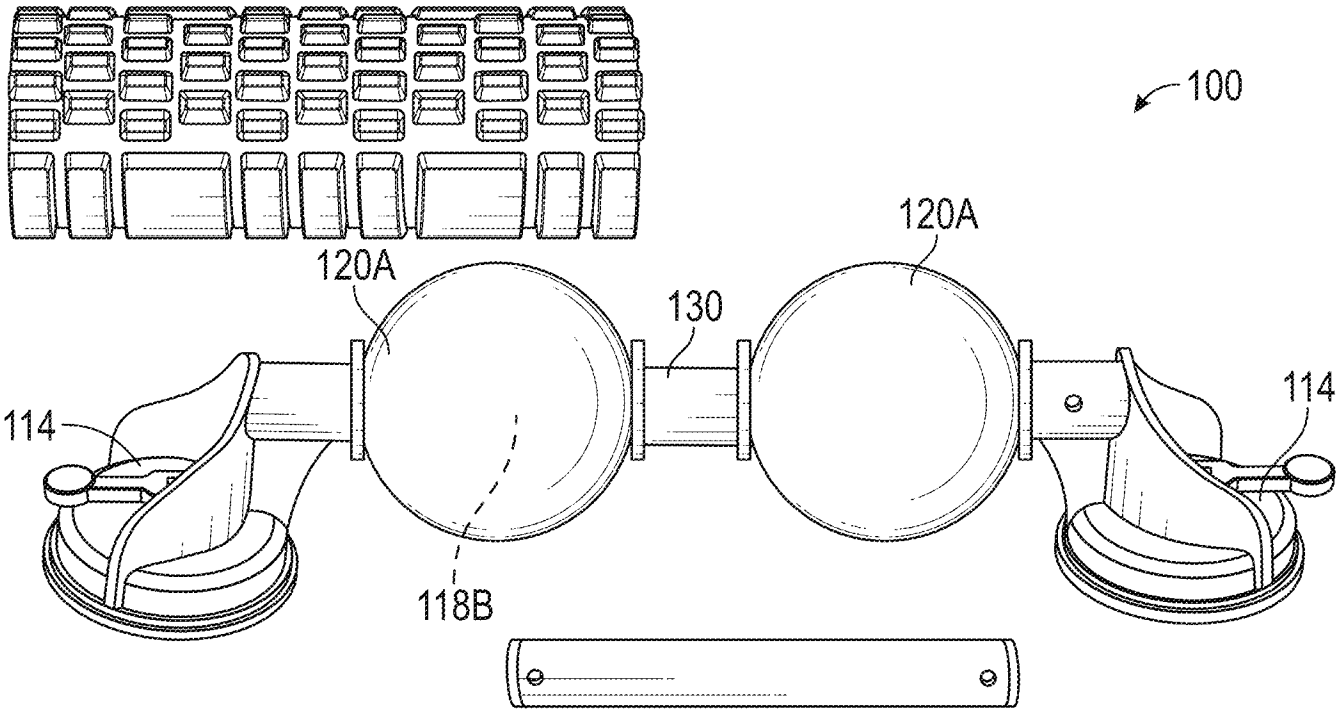
Figure 8A:
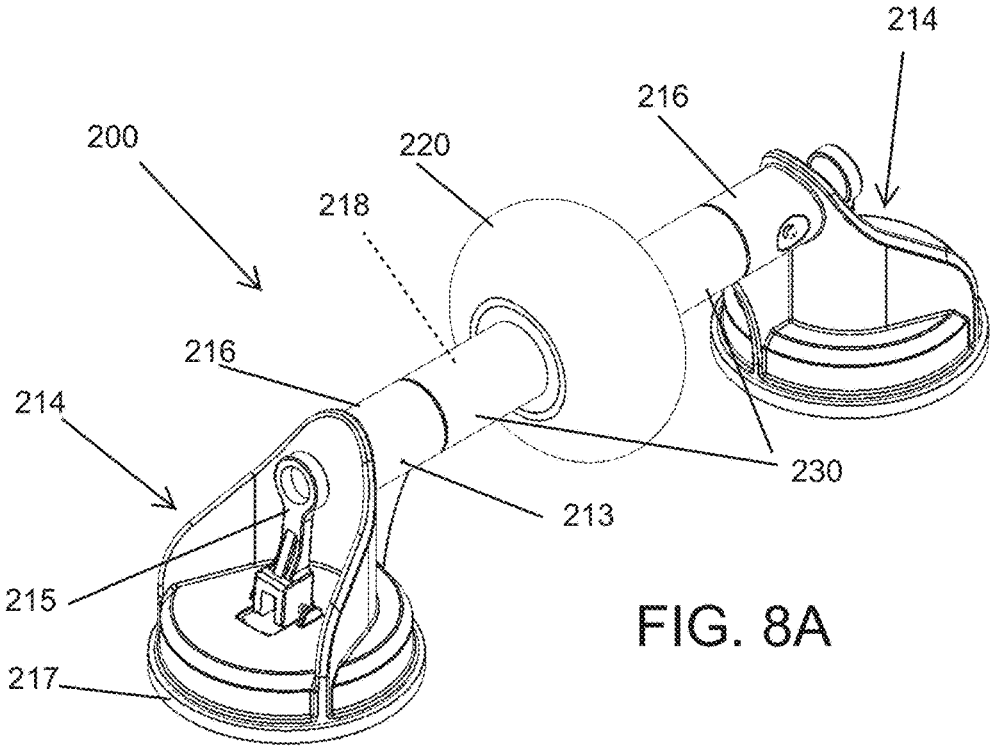
FIGS. 8A to 8H illustrate various views of a device having a wheel-shaped therapy member according to one embodiment.
Figure 8B:
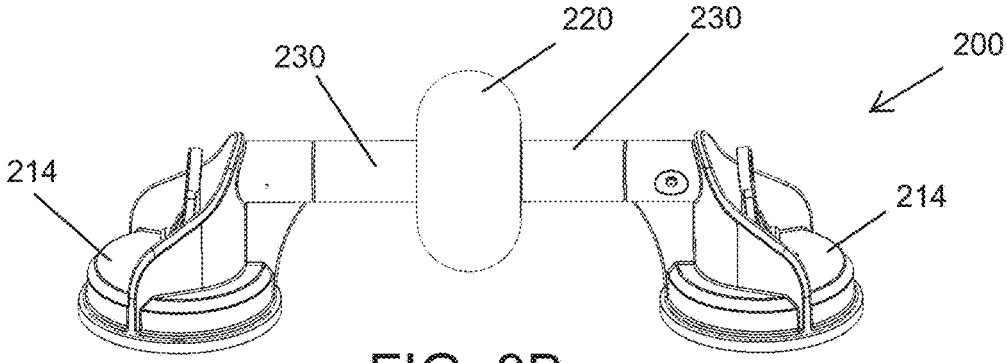
Figure 8C:
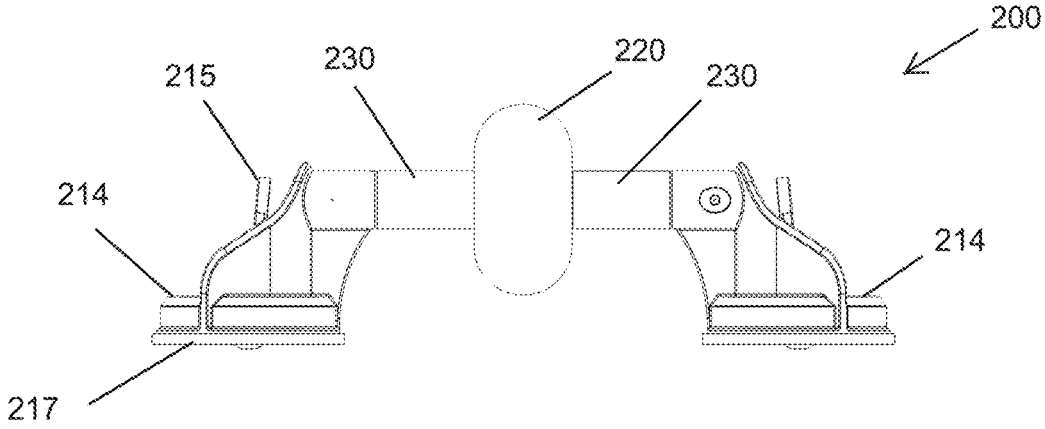
Figure 8D:
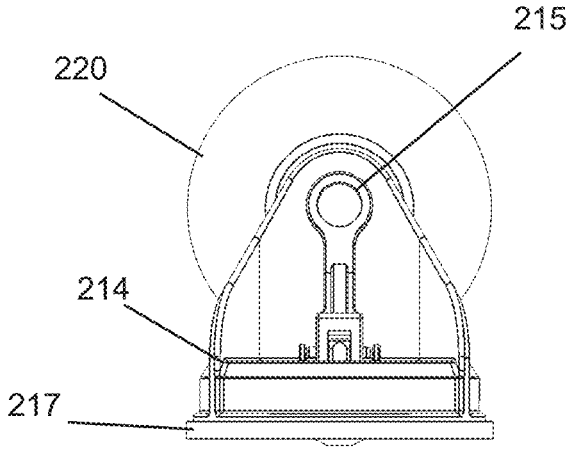
Figure 8E:
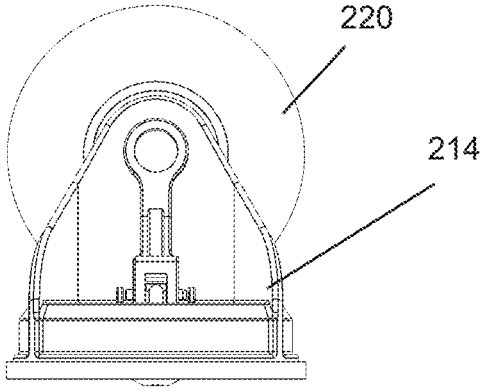
Figure 8F:
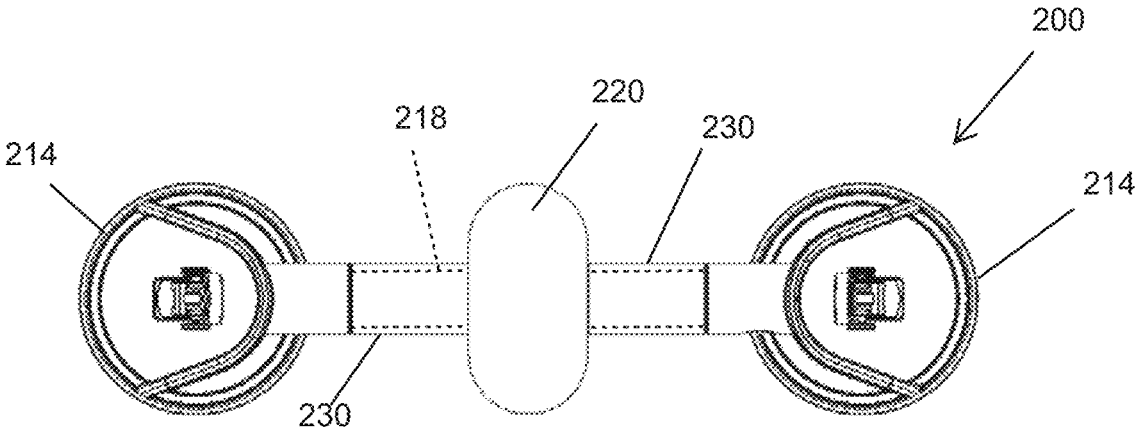
Figure 8G:
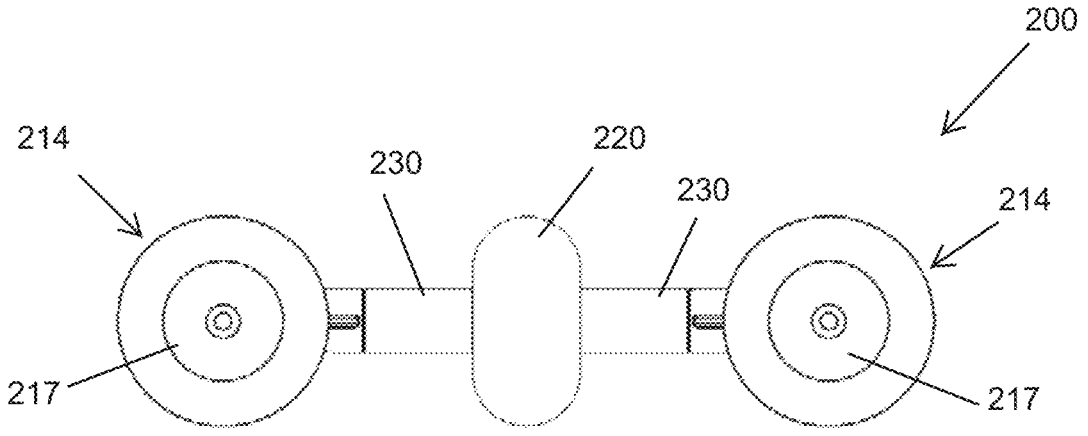
Figure 8H:
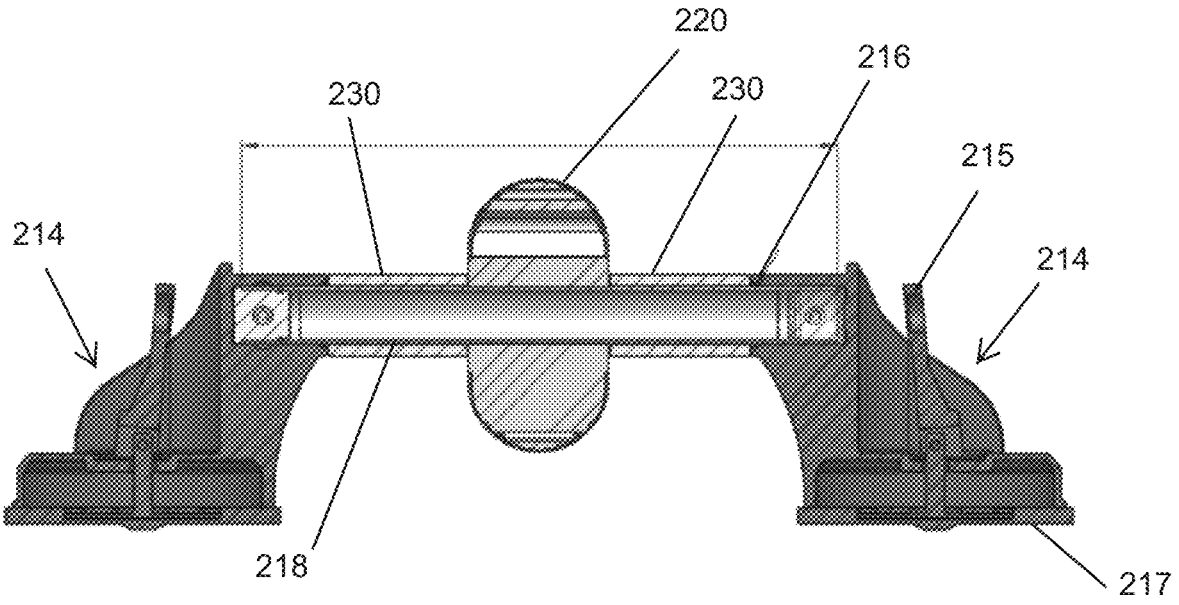

FIG. 7B illustrates another assembly of a therapy device created by selectively configuring the various components of the system or kit 100. As shown, the resulting assembly is symmetrical in that the therapy members 120A are equally spaced from each of the adjacent base members 114 and the center of the assembled device. To achieve such a configuration, as illustrated in FIG. 7B, the spacer 130 has been positioned between the two therapy members 120A.

The modular nature of such a system or kit can permit a user to customize his or her device in accordance with a desired or required protocol. The system can be advantageously modified (e.g., by quickly and easily disassembling and reassembling) the various components to achieve a different final configuration or assembly. Such a modular configuration can be incorporated to any of the embodiments disclosed herein. Thereby, a therapy device can be provided as part of a larger system or kit that includes a plurality of one or more components.

In any of the embodiments disclosed herein, a therapy device or system can include one more therapy members 20, 120, 220. Therapy members are configured to rotate about a fixed shaft and are configured to contact a user while the device or system is being used. As illustrated in the various embodiments illustrated and discussed herein, therapy devices can be provided in a variety of shapes, sizes and other configurations, depending on the desired or required therapy or treatment protocol. For example, as discussed above with reference to FIGS. 4 to 7B, a therapy member 120A, 120B can include a spherical or ball shape, a cylindrical shape and/or any other shape (e.g., wheel shape with rounded surfaces, cammed shape, spring shape, sprocket shape, other regular or irregular shapes, etc.). Accordingly, the shape, dimensions and/or other properties of any therapy members used in conjunction with any arrangements disclosed herein can be advantageously modified to achieve a desired therapy device, system or kit. Likewise, the rigidity or flexibility, the pliability, the ability to conform to a user's body, the ability to resist heat, moisture and/or other elements and/or other characteristics of the therapy members 20, 120, 220 can be customized, as desired or required. For instance, in some embodiments, the therapy members comprises rigid or semi-rigid materials and/or construction. In such arrangements, the therapy members do not flex or flex very little when contacting a user during use. However, in other embodiments, the materials and/or construction of one or more of the therapy members allows the therapy member to at least partially flex and compress or otherwise move when pressure is applied to it.

Additional embodiments of therapy devices are illustrated in FIGS. 8A to 8H, 9A and 9B and 10A to 10E. Such devices, as with any other arrangements discussed herein, can be stand-alone devices or part of a larger, module system or kit (e.g., similar to what is disclosed with reference to FIGS. 4 to 7B), as desired or required.

With reference to FIGS. 8A to 8H, the therapy member 220 comprises a single wheel shaped member. As shown, the therapy member 220 includes a rounded shape; however, the outer profile of the therapy member 220 can vary, as desired or required. For instance, in some embodiments, the profile can include one or more corners or other non-rounded or less rounded portions. Such a configuration can provide more acute contact points when coming in contact with a user. In the device 200 of FIGS. 8A to 8H, only a single therapy member 220 is included. However, as discussed, a device can include two or more therapy members 220.

With continued reference to FIGS. 8A to 8H, the device 220 can include spacers 230 on either side of the therapy member 220. Thus, as shown, the therapy member 220 can be centered between the base members 214. However, in other embodiments, the therapy member 220 can be offset, non-centered (e.g., with respect to the base members 214) and/or non-symmetrical (e.g., as an overall device), in accordance with a desired configuration.

Figure 9A:
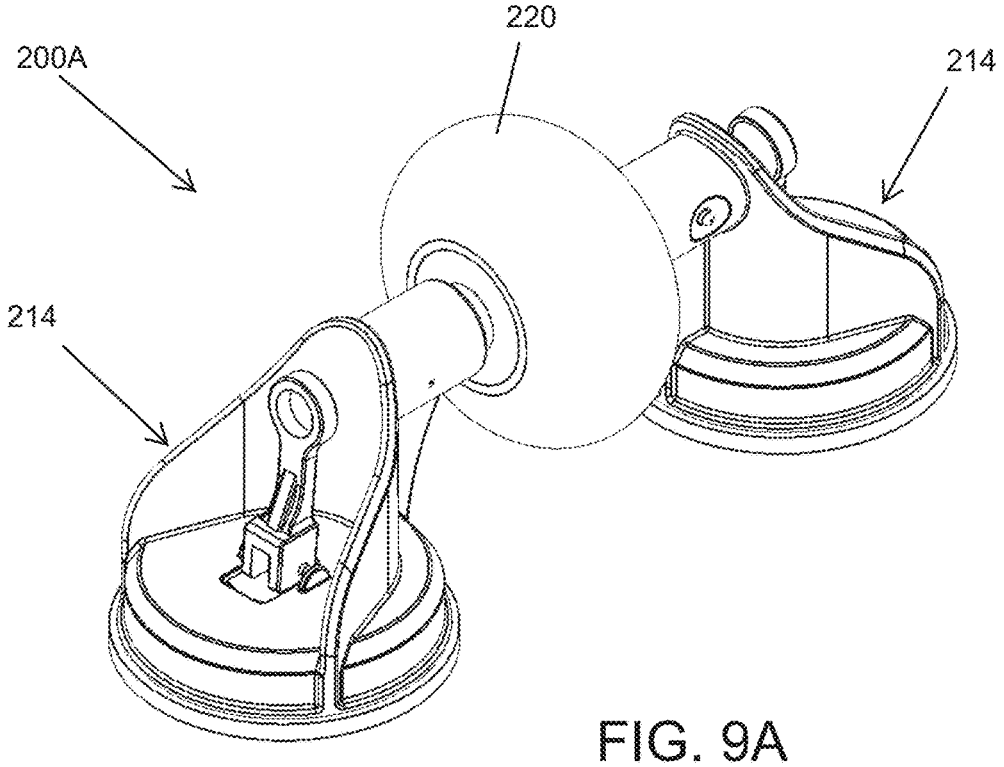
FIGS. 9A and 9B illustrate various views of a device having a wheel-shaped therapy member according to another embodiment.
Figure 9B:
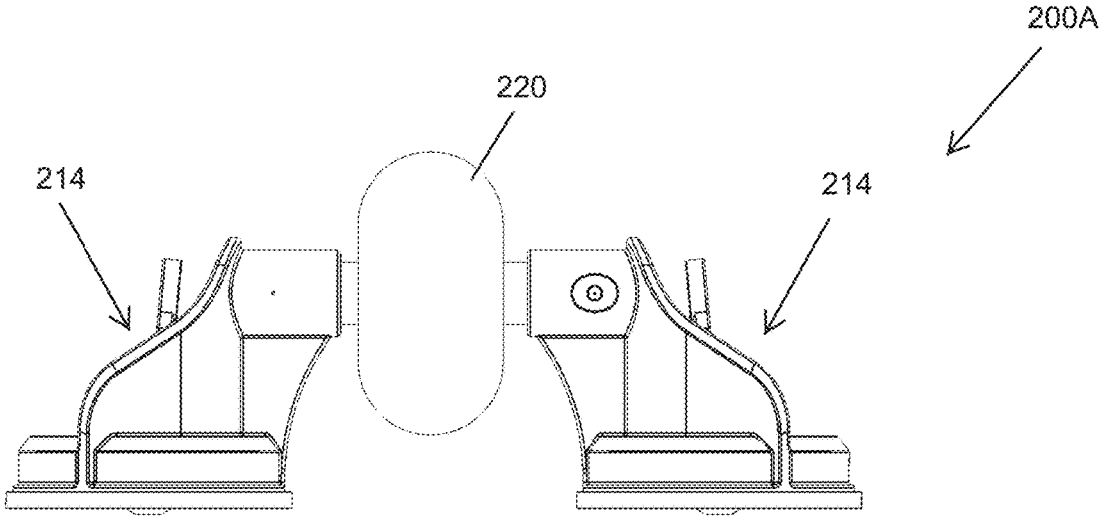

In some embodiments, the overall length or profile of a therapy device can be shortened. Such a configuration can be achieved, for example, by using a shorter shaft and/or eliminating one, more and/or all spacers, as desired or required. One such arrangement 200A is depicted in FIGS. 9A and 9B.

In some embodiments, as illustrated in FIGS. 10A to 10E, two or more therapy members 220 can be included in a single therapy device or system 200B. Therapy members 220 can be separated from each other using one or more spacers 230 (e.g., as shown in FIGS. 10A to 10E). However, in other embodiments, two or more therapy members 220 can be immediately adjacent one another (e.g., without a spacer between them), as desired or required.

Figure 11A:
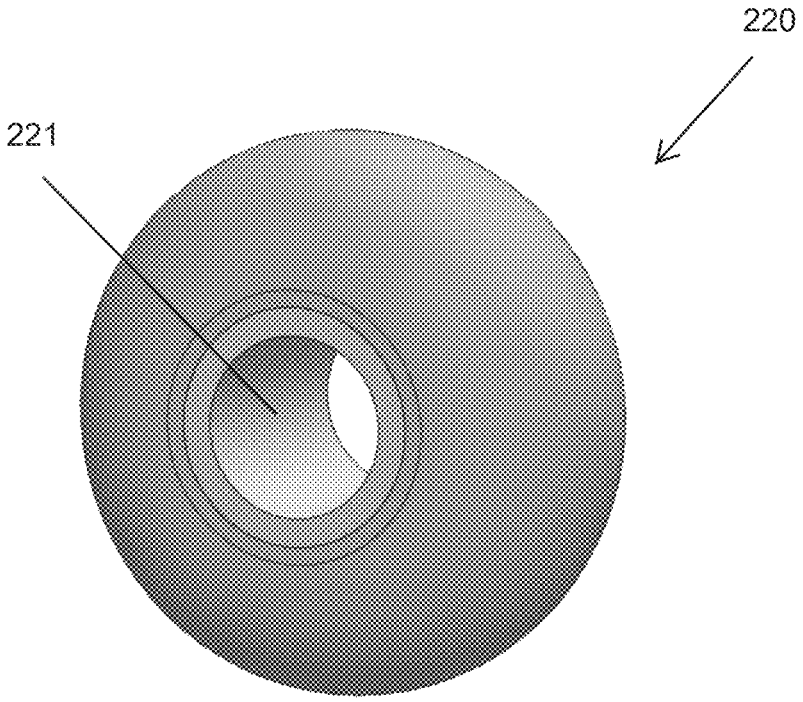
FIGS. 11A and 11B illustrate different views of a wheel-shaped therapy member according to one embodiment.
Figure 11B:
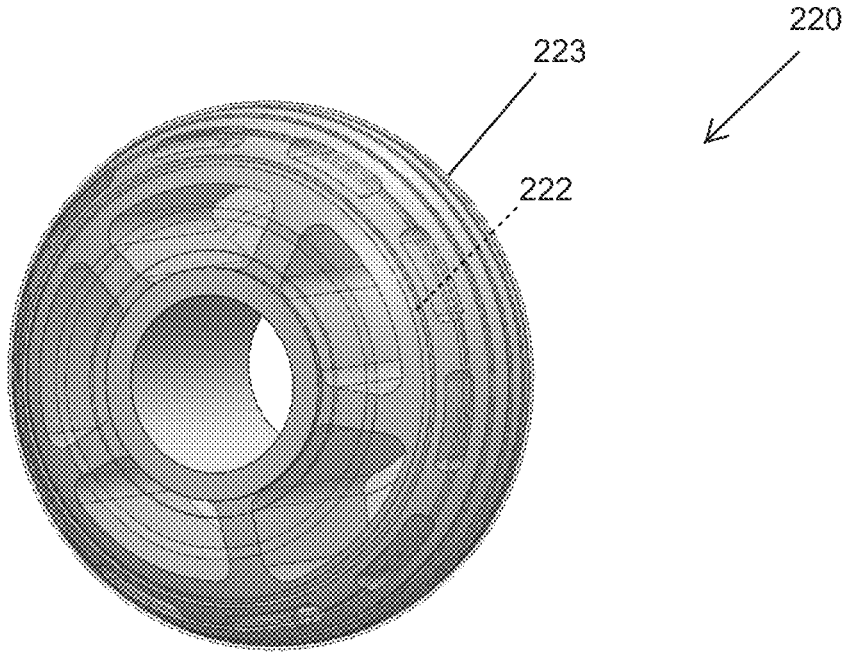

In some embodiments, a therapy member 20, 110, 220 can include a multi-layer or multi-component construction. For instance, as illustrated in FIGS. 11A and 11B, a wheel-shaped therapy member 220 can include an injection-molded substrate (e.g., inner portion) 222 that is overmolded with a second surface, layer, portion and/or component 223. In some arrangements, the outer surface or portion 223 is more flexible (e.g., softer, less rigid, more malleable, more pliable, etc.) than the inner member or portion 222.

Figure 10A:
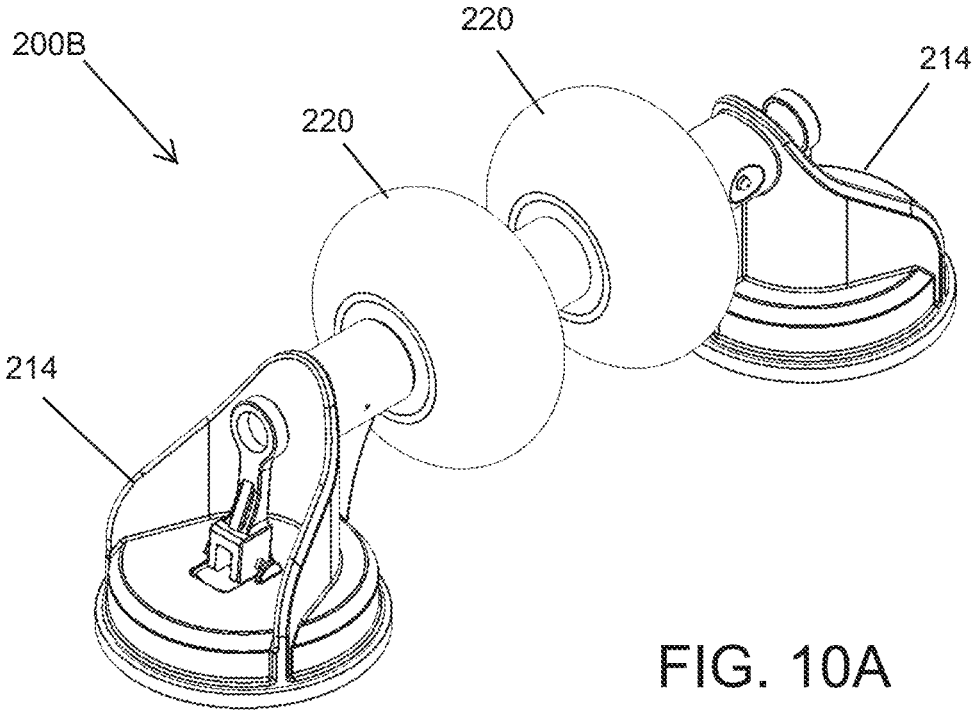
FIGS. 10A to 10E illustrate various views of a device having two wheel-shaped therapy members according to one embodiment.
Figure 10B:
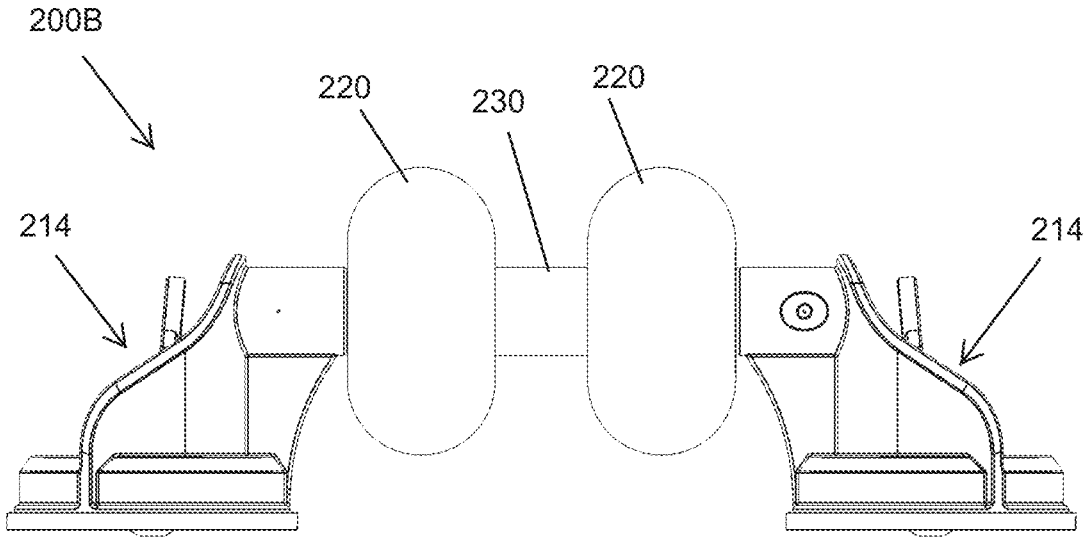
Figure 10C:
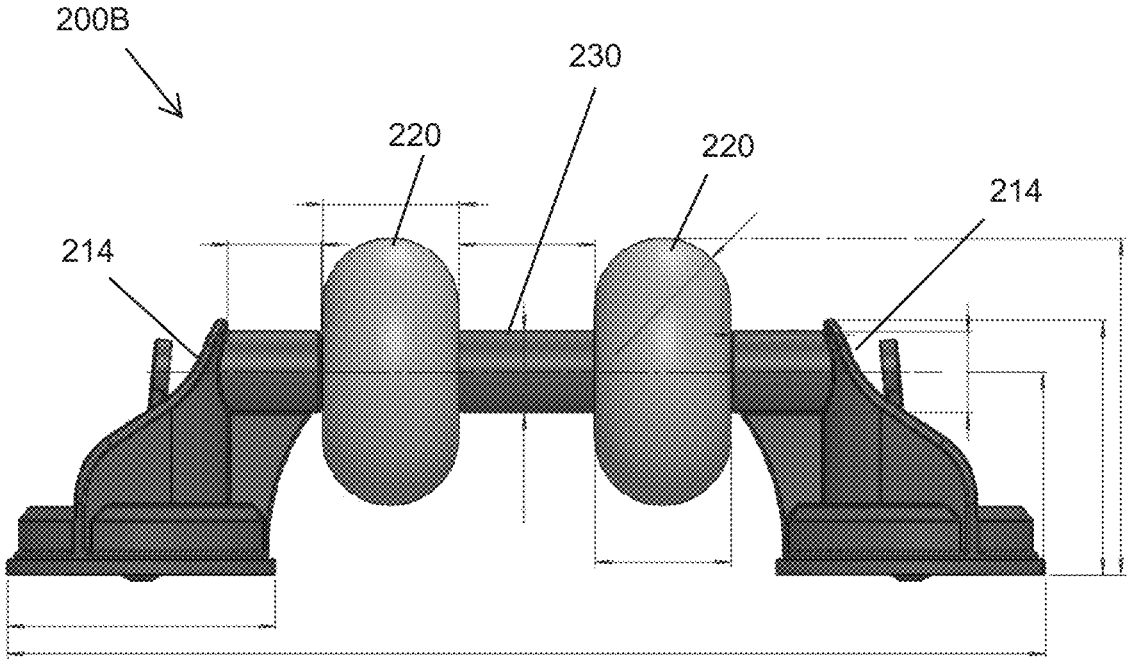
Figure 10D:
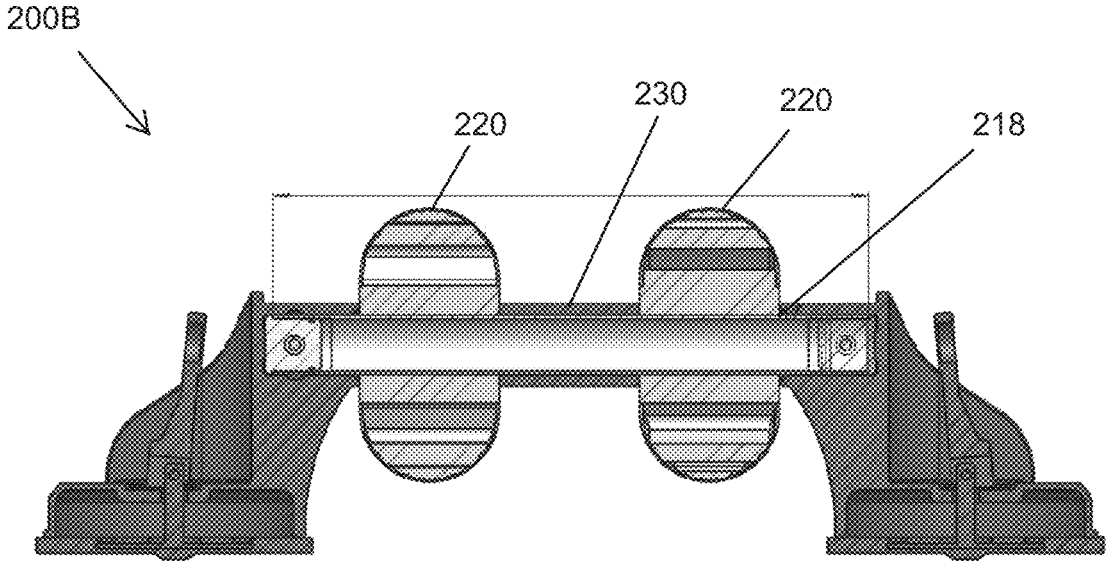
Figure 10E:
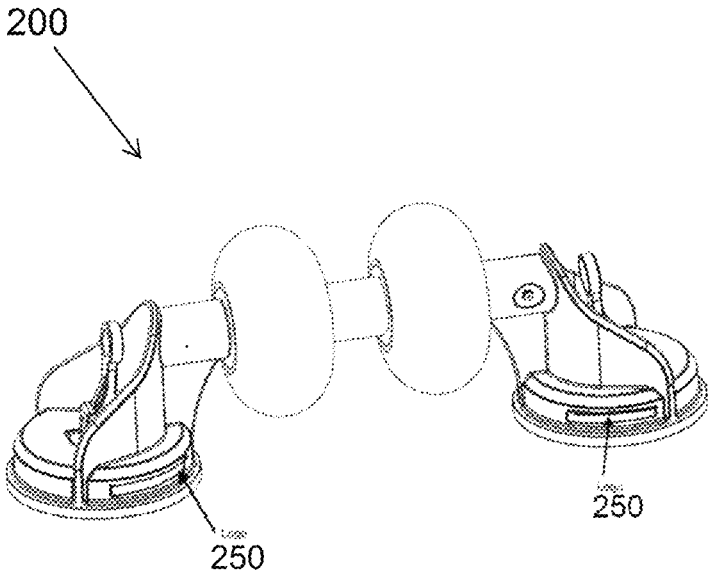

As illustrated in FIG. 10E, any of the device or system embodiments disclosed herein can include a logo or other identifier 250. Such a logo or identifier can include any combination of text, graphics and/or the like. Accordingly, the various arrangements illustrated and discussed herein can permit a manufacturer, seller and/or another entity in the chain of commerce to include a unique identifier to a resulting device or system (e.g., to allow for advertisement, marketing, sponsorship and/or source identification, to satisfy a branding or regulatory purpose and/or to achieve another purpose or goal).

Figure 12A:
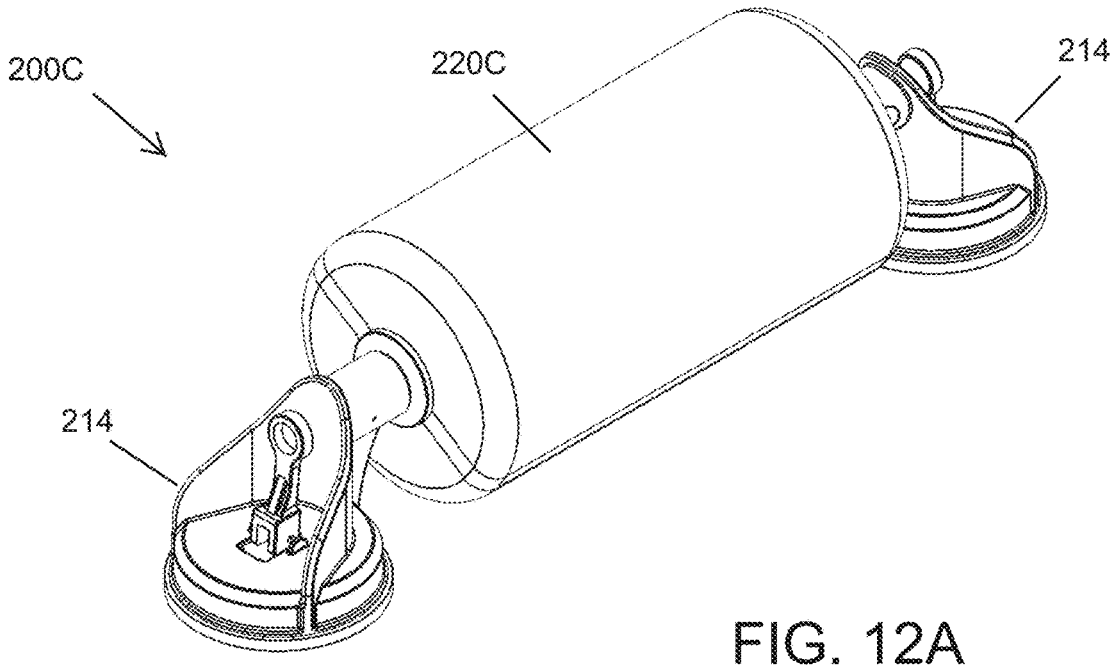
FIGS. 12A and 12B illustrate various views of a device having a cylindrical therapy member according to one embodiment.
Figure 12B:
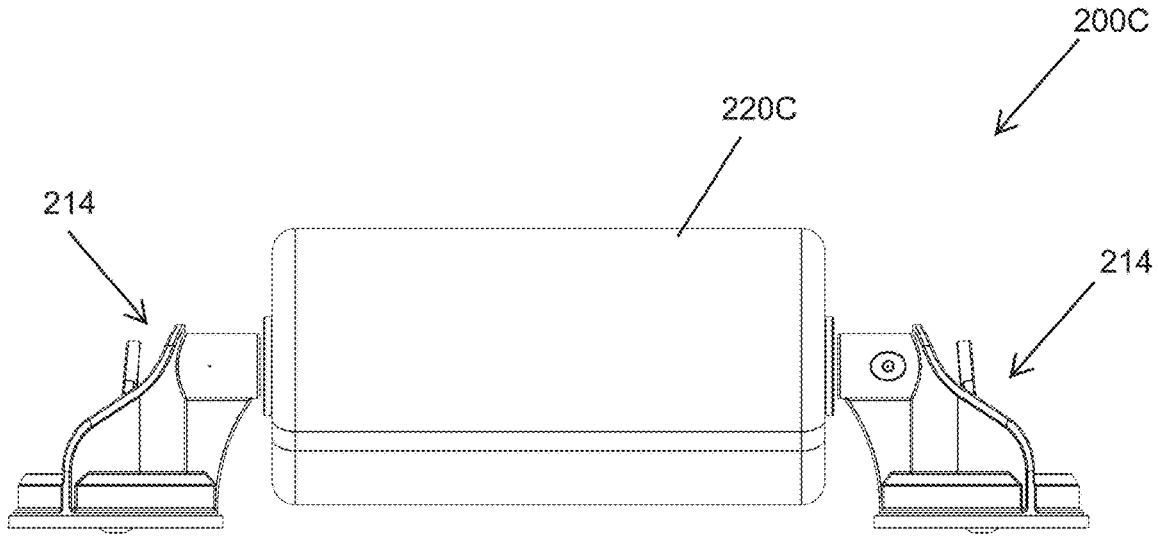

FIGS. 12A and 12B illustrate an embodiment of therapy device 200C that include a single, longer therapy member 220C. As shown, such a therapy member 220C can include a generally cylindrical shape. However, as noted, the shape of the member 220C can vary in accordance with a desired or required protocol.

Any of the components or portions of the therapy devices and/or systems disclosed herein can include a solid, hollow and/or partially-solid or partially-hollow construction. For example, as shown in FIG. 11B, a therapy member 220 can include a partially hollow or partially solid construction. Likewise, the shaft and/or any other portion of the device or system can be solid, hollow and/or a combination of solid and hollow, as desired or required.

In some arrangements, the therapy components or members 20, 120, 220 comprise one or more polymeric and/or other materials having favorable wear-resistant. Any type of polymer, elastomer, fabric, leather, other natural or synthetic material can be used, as desired or required. Specifically, the therapy or contact member or assembly 20, 120, 220, which is configured to contact the user during a particular therapy procedure, can comprise one or more materials, such as for example and without limitation, natural or synthetic cork, polypropylene, ethylene vinyl acetate, expanded polypropylene, other polymeric and/or elastomeric materials and/or any other materials, as desired. In some embodiments, such materials provide a modulus of elasticity that imparts the characteristics of the flesh of a human hand or foot.

As noted herein, the therapy or contact assembly or member 20, 120, 220 can include any desired shape, size and/or configuration. For example, the shape of the therapy assembly 20 can be a sphere, a cylinder, a wheel (e.g., with or without rounded edges), a, hemisphere, a torus, a torus, a helix, a cone (e.g., a truncated cone), a sprocket, a cammed shape, a spring shape and/or the like. In some embodiments, the diameter or other cross-sectional size of the therapy assembly is 2 to 18 inches (e.g., 4-16, 6-12, 2-4, 4-6, 6-8, 8-10, 10-12, 12-14, 14-16, 16-18 inches, dimension between the foregoing ranges, etc.). Alternatively, the diameter or other cross-sectional size of the therapy assembly can be less than 2 inches or more than 18 inches, as desired or required.

In any of the therapy embodiments disclosed herein, the therapy members can include any combination of smooth and/or non-smooth outer surfaces (e.g., for contact with a user). For example, non-smooth therapy members can include one or more surface features (e.g., dimples, other protrusions, dimples, etc.) along all or at least a portion of the outside of the therapy assembly or member 20, 120, 220. Such features and/or configurations can provide contact with the users body in a manner that optimizes or otherwise enhances or improves contact with an identified myofascial trigger point. In some embodiments, the massage device assembly may include mechanisms to allow heating or cooling or vibration to provide additional therapeutic effect.

In some embodiments, the shaft of the therapy device or system is configured to not rotate during use. In other words, the shaft is stationary during use. Thus, in some arrangements, the shaft is stationary while one or more therapy members that are secured to the shaft are free to rotate or otherwise move. In some embodiments, the shaft is secured (e.g. at one or both ends) using a detect and corresponding hole arrangement and/or another type of mechanical or other attachment method or feature. In some arrangements, one or both ends of the shaft are secured to a base member using a detent (e.g., spring activated detent) and corresponding opening system that prevent both translation and rotation of the shaft relative to the base member. In some arrangements, one end of the shaft is secured to a base member using a detent (e.g., spring activated detent) and corresponding opening system that prevents both translation and rotation of the shaft relative to the base member, while the other end of the shaft is secured to the opposite base member in a manner that prevents translation (e.g., prevents separation of the shaft from the base member), but permit rotation of that end of the shaft relative to the corresponding base member. Such a configuration can facilitate movement of the base members in various orientations, during use, while advantageously still preventing rotation of the shaft.

As noted wherein, the base members of a therapy system can be configured to removably or detachably secure to any wall, floor and/or other planar or generally planar surface. For example, in some embodiments, the base members comprise a suction system including a pliable diaphragm 15, 117, 217, that when raised by depressing the locking tab or lever 16, 115, 215 to create a vacuum that binds the base to a corresponding surface. However, in other embodiments, any other type of releasable connection method or feature can be used to secure a base member to a surface, including, without limitation, magnets or magnetic connections, hook and loop connections, mechanical fasteners, adhesives and/or the like.

Figure 13:
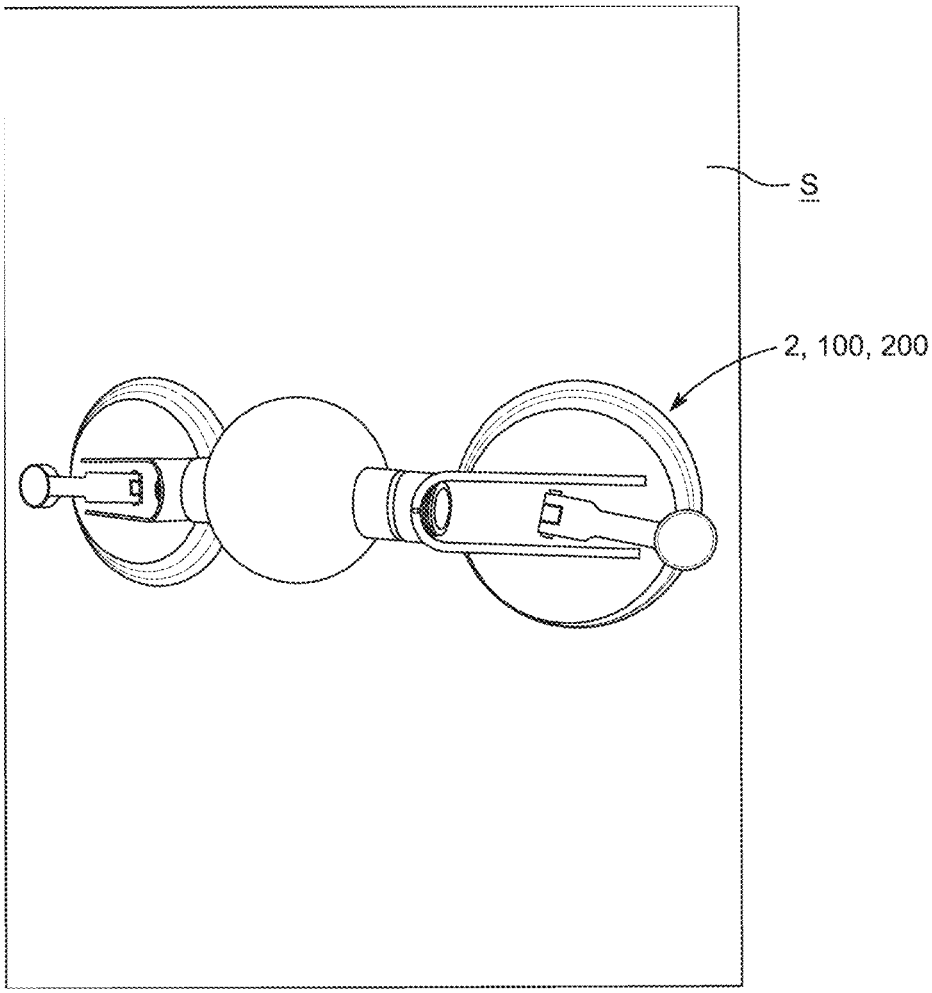
FIG. 13 illustrates one embodiment of a therapy device mounted to a wall or other surface.
Figure 14A:
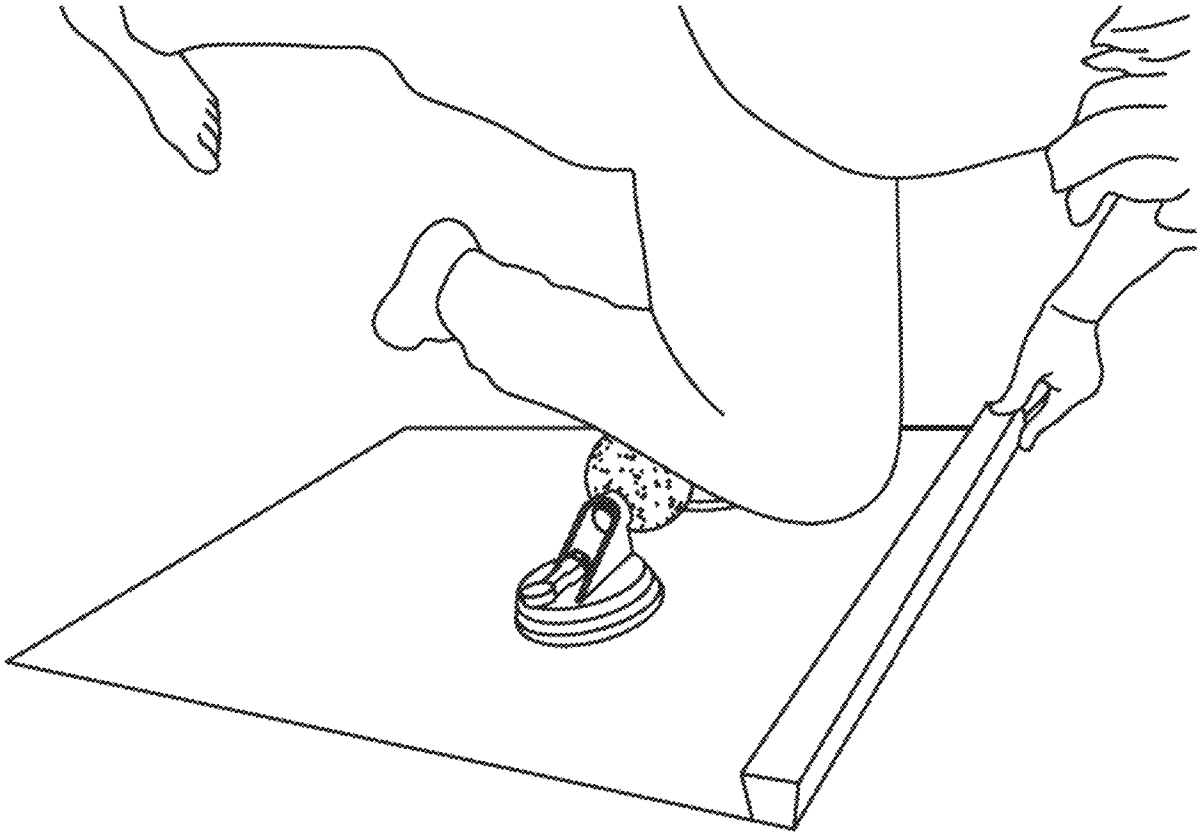
FIGS. 14A to 14C various view of one embodiment of a therapy device mounted on a wall or other surface while in use by a user.
Figure 14B:
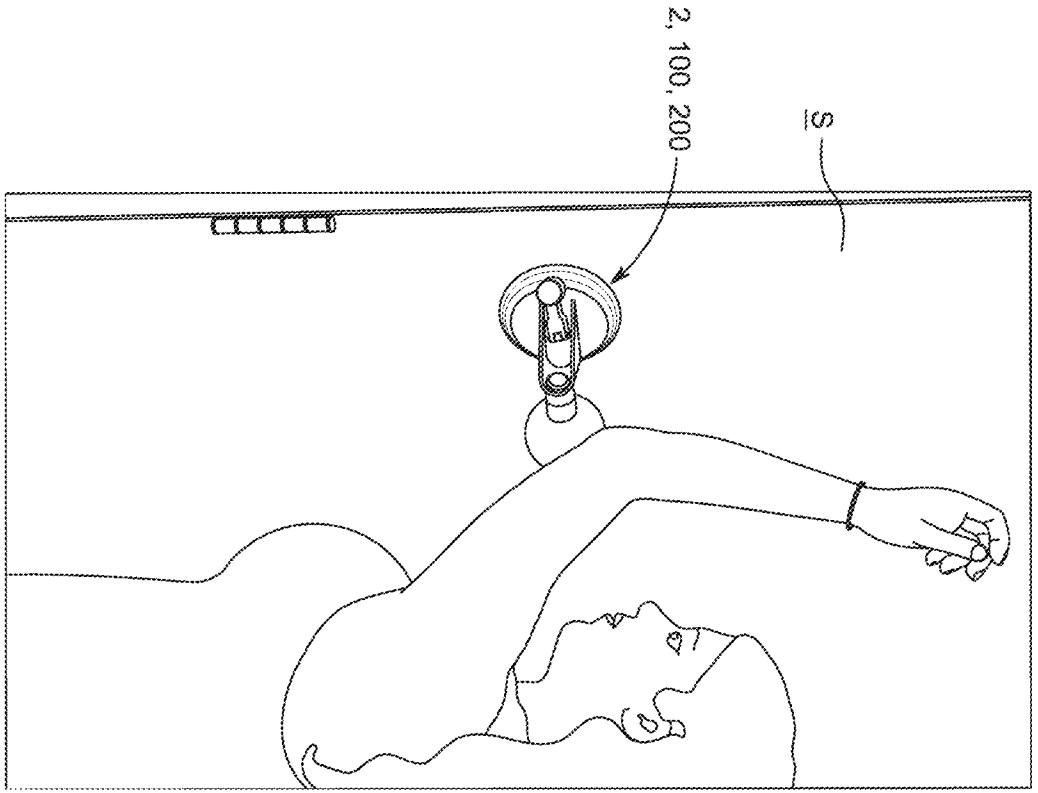
Figure 14C:
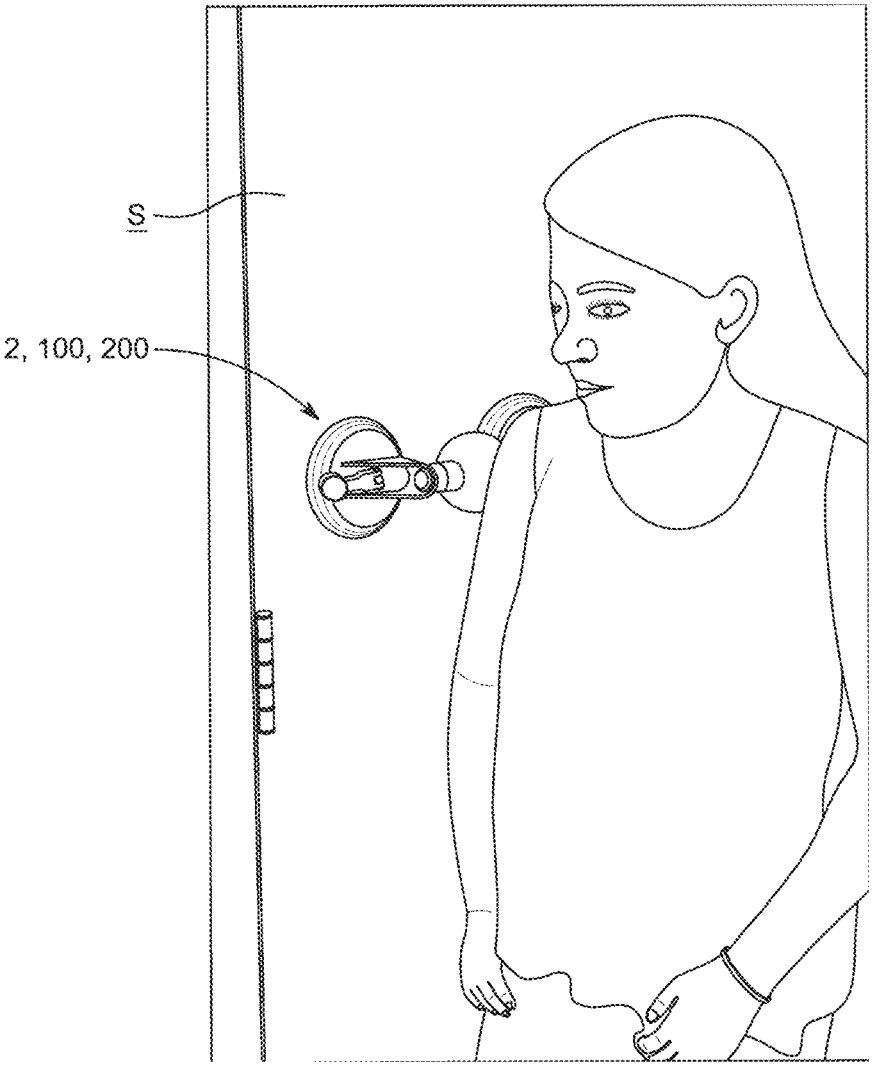

Regardless of the exact releasable connection device, feature and/or technology used, the base members can be secured to a wall, floor and/or any other planar (or generally planar) surface in any desired orientation, angle and/or the like. For example, as illustrated in FIGS. 13 to 14C, a therapy device or system 2, 100, 200 can be secured to a wall, floor, other surface and/or the like in a manner that positions the device or system in a desired or required orientation relative to the user. Thus, for any of the embodiments disclosed herein, a therapy system can be positioned vertically, horizontally and/or diagonally (e.g., relative to a ground or floor surface). Further, the device or system can be quickly and easily repositioned in accordance with a desired or required protocol.

As discussed in greater detail herein, any of the therapy devices or systems disclosed herein can include one or more sensors. Such sensors can include, without limitation, a pressure sensor, a proximity sensor, a location sensor, a strain sensor, a temperature sensor, a humidity sensor, an elevation sensor, a position sensor, a rotational sensor, a motion or movement sensor and any other type of sensor. Such sensors can be configured to obtain information, collect it, save, process it, transmit it and/or manipulate it in any desired or required manner.

For example, as discussed herein, such sensor data and information can be directed to a processor that is included in a stand-alone or associated device (e.g., smartphone, tablet, computer, etc.) to provide feedback to the user. For example, in some embodiments, pressure sensors (e.g., thin film sensors located at or near each of the base members) can detect when a user is applying uneven pressure (e.g., undesirably favoring one side of the therapy member or device over the other). Thus, such sensor data can be used to alert the user of any potentially dangerous, undesirable and/or otherwise problematic use of the device or system, thereby giving the user an opportunity to understand an issue and provide him or her with guidance for correction.

In some embodiments, for example, a position or an elevation sensor can be used to ensure that the user can properly positioned the device or system. In some embodiments, a user can input data (e.g., regarding the desired protocol, targeted anatomical location, his or her characteristics such as gender, weight, height, age, etc.). The system can be configured to provide feedback to the user with respect to a recommended protocol. For instance, the system can be configured to process any data provided by the user, with or without incorporation of any sensor data (e.g., elevation or position data, pressure data, temperature, humidity, etc.), and provide recommended instructions to the user (e.g., what protocol to perform, where to position or reposition the therapy device, how to reconfigure the device, etc.).

In some embodiments, one or more batteries (e.g., a rechargeable battery) are embedded, at least partially, within the shaft or other extension member 18. In other arrangements, wires and other electrical circuitry and/or other components, are positioned within an interior of the shaft 18. Such a configuration can permit the design to have an external battery or electrical power connection along a desired portion of the shaft 18.

According to some embodiments, mounted within the shaft are one or more pressure sensitive devices such as a film-based pressure-sensing pad below the first surface of the roller. The pressure sensing film can measure total load and/or pressure points along the length of the roller or other contact assembly 20 of the therapy device. In some embodiments, one or more sensors are mounted within or otherwise positioned relative to the shaft 18 and other portion of the support member 10 and/or the contact assembly 20 of the therapy device. Such sensors can include any type of sensor that may be incorporated into evaluating, improving and/or affecting or otherwise impacting a therapy protocol. A sensor can include, but is not limited to, a pressure sensor, a proximity sensor, a vibration sensor, a motion sensor, a temperature sensor, a humidity sensor and/or any other type of sensor.

In other arrangements, sensors that provide data and otherwise inform the system and/or facilitate a therapy protocol can be located in locations other than the therapy device. For example, sensors can be included in devices that are worn or carried by a user (e.g., Fitbit-type watch, a smartwatch, a heartrate monitor, a wearable strap or band (e.g., elastic band that is worn across the chest), etc.). The system can be configured to receive data from any sensors, whether or not incorporated into the system, whether or not manufactured or provided by the provider of the system, etc., to improve the functionality of the system. For instance, cardiac pulse data (e.g., received form a user's heartrate monitor) can be provided to the processor so that the touchscreen or other user interface can provide warnings, encouragement and/or other information to the user. In some embodiments, the system is configured to receive data from one or more ambient sensors (e.g., local time, temperature, humidity, etc.) located at or near the vicinity of the system.

In some embodiments, a processor (e.g., microprocessor) is configured to receive and process signals from sensors (e.g., sensors embedded in the shaft that represent relative applied pressure, movement that is computationally related to the user's use of the system, sensors positioned in other portions or components of the system, sensors worn by a user, ambient sensors, data obtained from the internet (e.g., local conditions based on zip code or exact location), etc.).

Data and/or other information from a sensor and/or any other device or component that is operatively coupled to the system can be transmitted to and/or from various system components and/or non-system devices using a wired or wireless protocol. For example, a wireless communication device or component (e.g., one that uses Wi-Fi and/or Bluetooth) can receive such user activity information from the microprocessor, such as, for example, relative pressure, and communicate it other components of the system, e.g., the microprocessor (e.g., FIG. 23). In some embodiments, a universal serial bus (USB) port and the associated connections (e.g., cable) are included in the system (e.g., embedded within the shaft or other system component). A USB device that is configured to fit within such a port can also be included. In some embodiments, the USB device or similar technology is integrated with the embedded microprocessor, battery and/or any other components. Thus, by interfacing with the USB, an external electronic device can recharge the battery and communicate with the embedded microprocessor for functions such as initialization, data retrieval and executing diagnostic functions.

FIG. 3C illustrates one embodiment of a massage or other contact assembly 20 that is secured to the support member 10 (e.g., to the shaft of the mounting carriage or support member). In some embodiments, the therapy (e.g., massage) or contact assembly 20 includes one or more tube components or members 24 extending from it or its vicinity, as illustrated in the embodiment of FIG. 3C.

In some arrangements, the tube components or members 24 comprise one or more polymeric and/or other materials having favorable wear-resistant and low friction properties, such as, for example, polyoxymethylene or self-lubricating nylon. However, any other type of polymer, elastomer, fabric, leather, other natural or synthetic material can be used, as desired or required. The sleeve can include and/or can be secured to a contact or therapy assembly 20. The therapy or contact assembly 20, which is configured to contact the user during a particular therapy procedure, comprise one or more materials, such as for example, natural or synthetic cork, polypropylene, ethylene vinyl acetate, expanded polypropylene, other polymeric and/or elastomeric materials and/or any other materials, as desired. In some embodiments, such materials provide a modulus of elasticity that imparts the characteristics of the flesh of a human hand or foot.

The therapy or contact assembly 20 can include any desired shape, size and/or configuration. For example, the shape of the therapy assembly 20 can be a sphere, a, hemisphere, cylinders, a torus, a torus, a helix, a cone (e.g., a truncated cone) and/or the like. In some embodiments, the diameter or other cross-sectional size of the therapy assembly is 2 to 18 inches (e.g., 4-16, 6-12, 2-4, 4-6, 6-8, 8-10, 10-12, 12-14, 14-16, 16-18 inches, dimension between the foregoing ranges, etc.). Alternatively, the diameter or other cross-sectional size of the therapy assembly can be less than 2 inches or more than 18 inches, as desired or required.

In some embodiments, various surface features (e.g., dimples, other protrusions, dimples, etc.) are included along all or at least a portion of the outside of the therapy assembly 20 (e.g., to provide contact with the users body in a manner that optimizes contact with an identified myofascial trigger point). In some embodiments, the massage device assembly may include mechanisms to allow heating or cooling or vibration to provide additional therapeutic effect.

Figure 15:
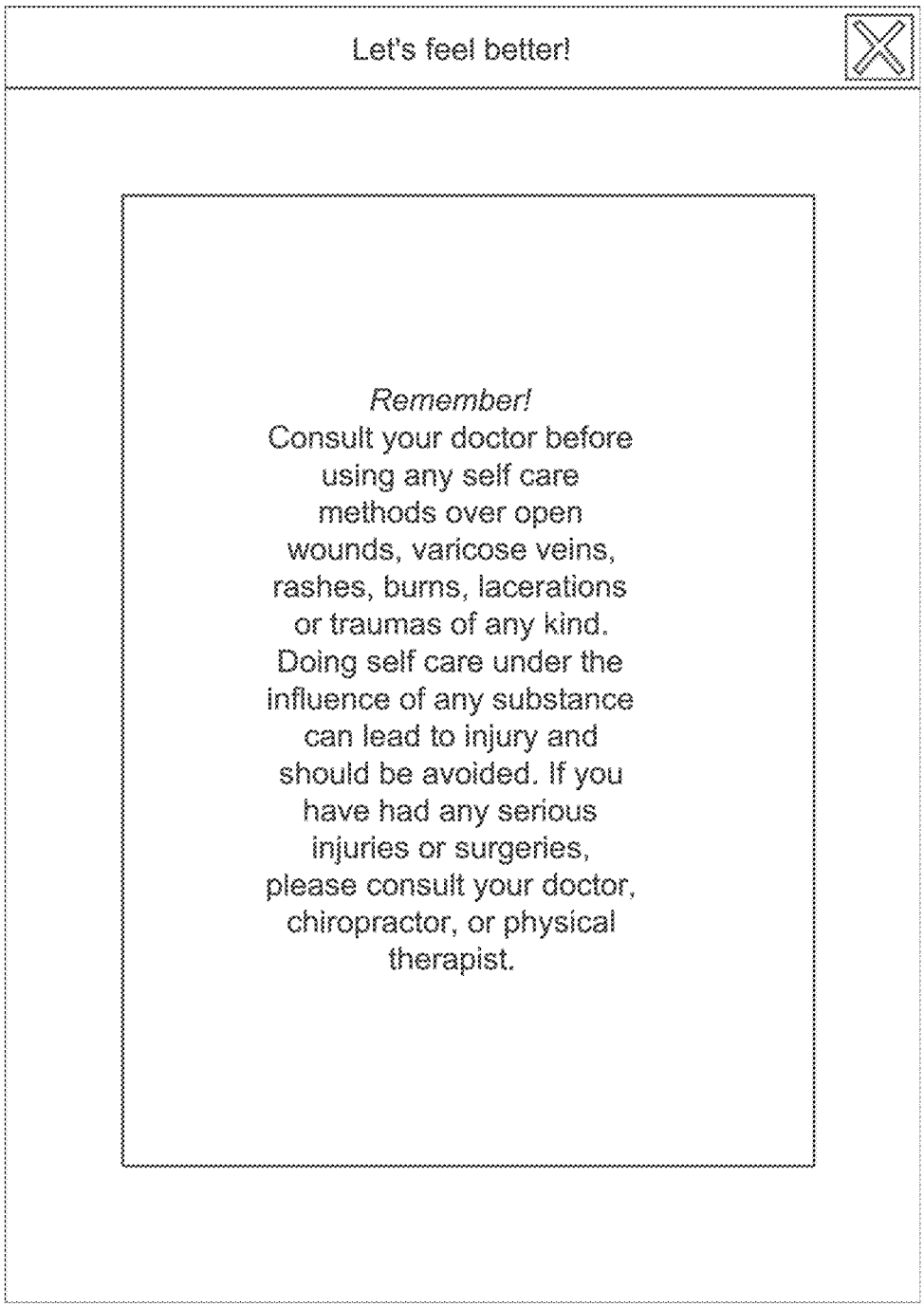
FIGS. 15 to 22 illustrate different embodiments of example screen shots provided on a display that can be viewed and followed by a user during a therapy procedure.

FIG. 15 illustrates one embodiment of an interface screen (e.g., via an electronic tablet) that can interact with a user of a self-administered therapy system. With specific reference to FIG. 15, software (e.g., via an application for a tablet or a smartphone) can be configured to advise a user on general precautions to consider prior to using the device and administering a massage therapy protocol. Thus, the system and related technology disclosed in this application can be customized with any warnings, disclaims, informational notes, etc., as needed or required by a particular set of circumstances.

As disclosed by the example provided herein, in some embodiments, the user interface (e.g., a display or other output of a tablet, monitor, etc.) can be configured to guide the user through a series of interactive screens. For example, the user can make the necessary selections (and/or acknowledgements) at each phase by touching the screen with his or her finger, by touching the screen using a stylus or other device, by providing an oral command, using a keyboard, keypad or other input device and/or the like).

Figure 16:
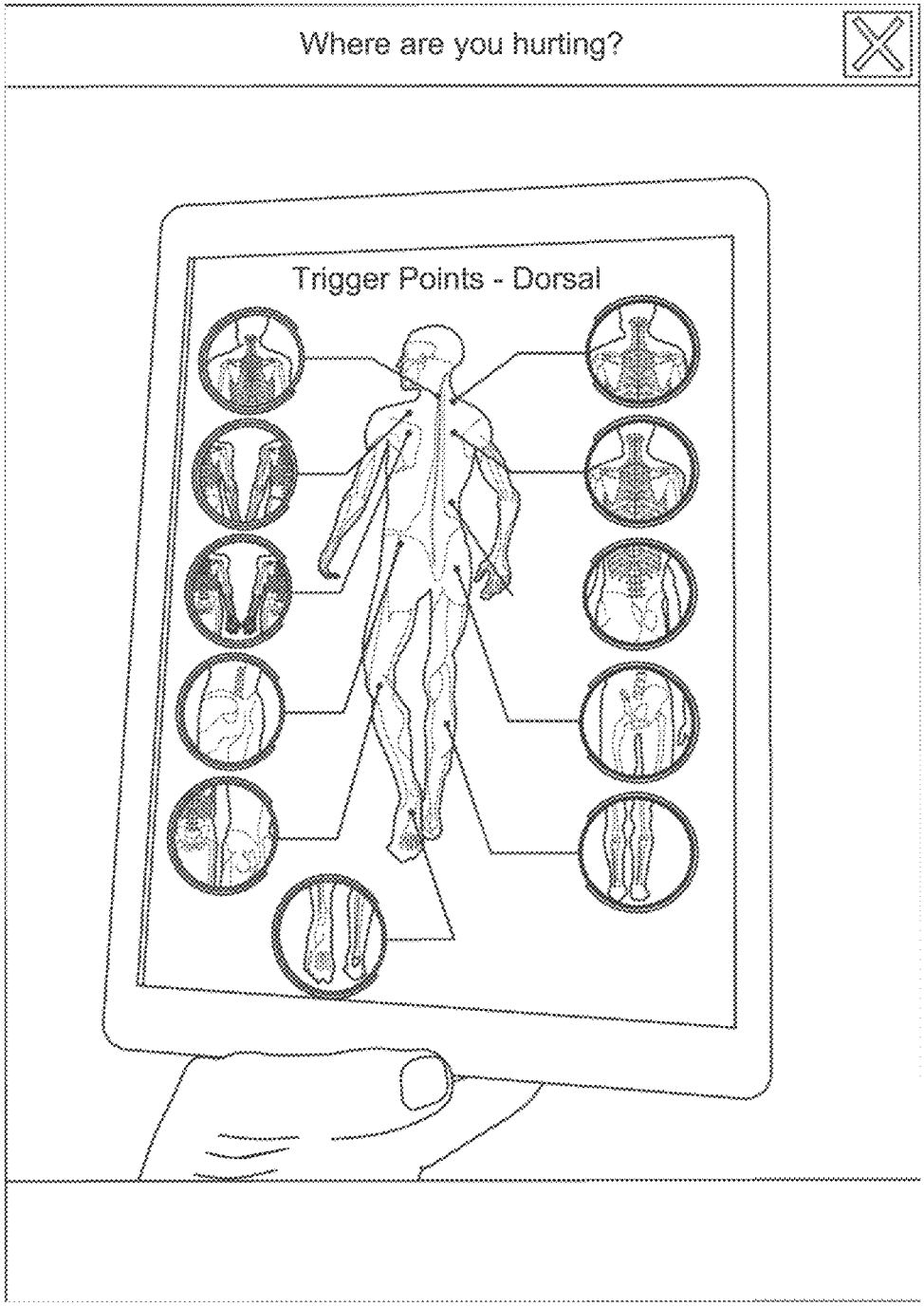
Figure 17:
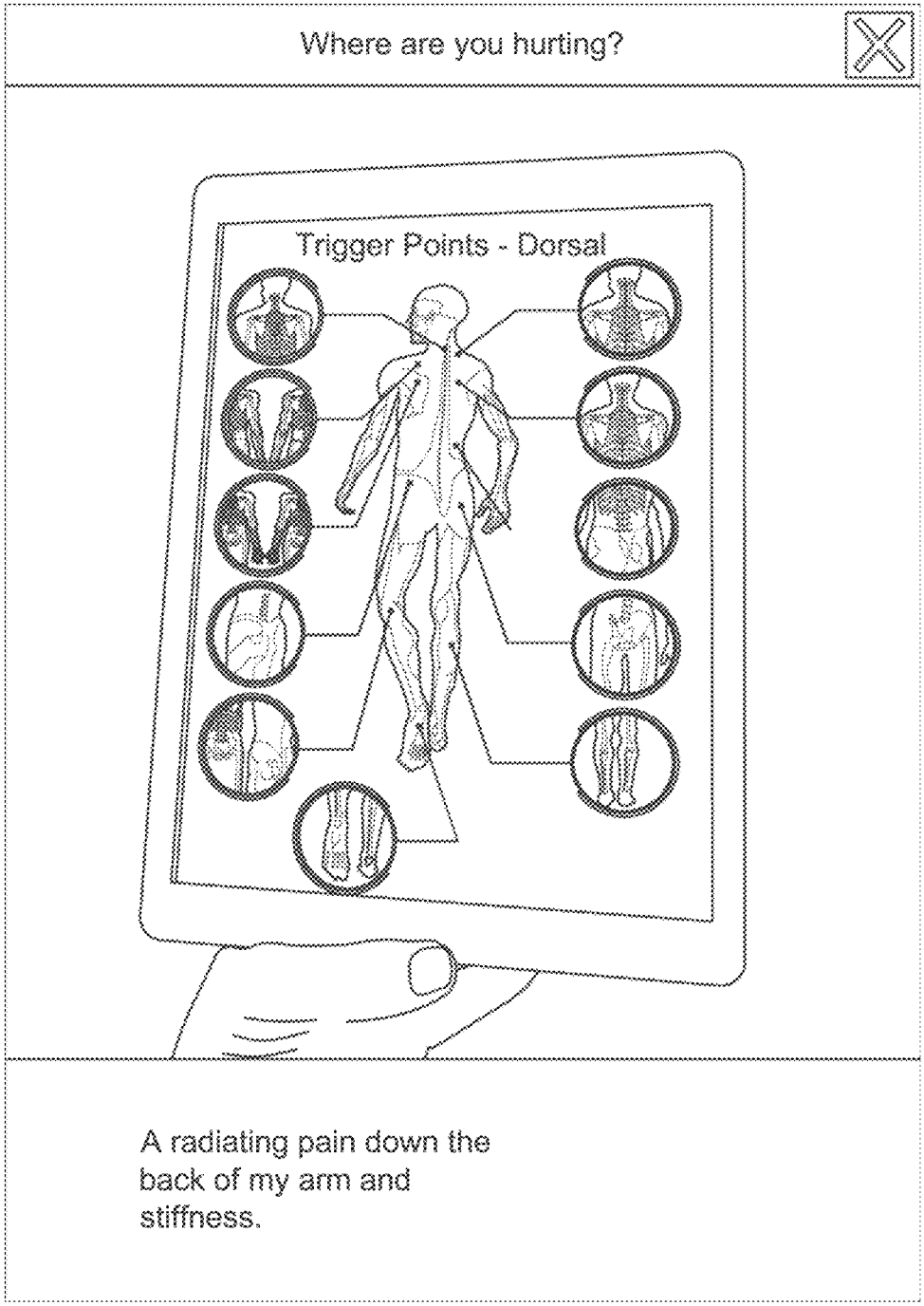

With continued attention to the example embodiment provided herein, as shown in FIGS. 16 and 17, the system (e.g., via a processor, software, etc.) can be configured to receive certain data and/or other information from the user. In some embodiments, the system can be configured to also receive data and information from one or more sensors. The sensors can be incorporated into one or more devices, portions or components of the system, as provided to the user. However, in other embodiments, such sensors can be supplied by a third party (either in lieu of or in addition to any sensors incorporated into the system supplied to a user). Accordingly, in some arrangements, the system (e.g., software, processor or other hardware, etc.) can be configured to receive and process signals from any third party sensors. Sensors can include sensors positioned on wearable devices (e.g., wristbands or watches with sensors, elastic bands with sensors such as bands that are configured for placement across or along a user's chest, etc.). Further, the system can be configured to receive one or more inputs using any other device or method, including, without limitation, smartphones, tablets, smart watches, dedicated input devices, etc.). In some embodiments, various components of the system can be incorporated into a single device. For example, the display (e.g., touchscreen), user input (e.g., the same touchscreen), hardware (e.g., processor) and software (e.g., application) can be incorporated into an electronic tablet. Such a tablet can be enabled with Bluetooth and/or any other type of wireless or hard-wired connectivity to advantageously incorporate inputs and/or outputs with other devices (e.g., a personal computer, the Internet or other network, a smartphone, a smartwatches and/or any other device. In some arrangements, therefore, sensor data and/or user dialogue or other user input (e.g., desired therapy, indications of pain or discomfort on the body, etc.) can be communicated to the overall system.

Figure 18:
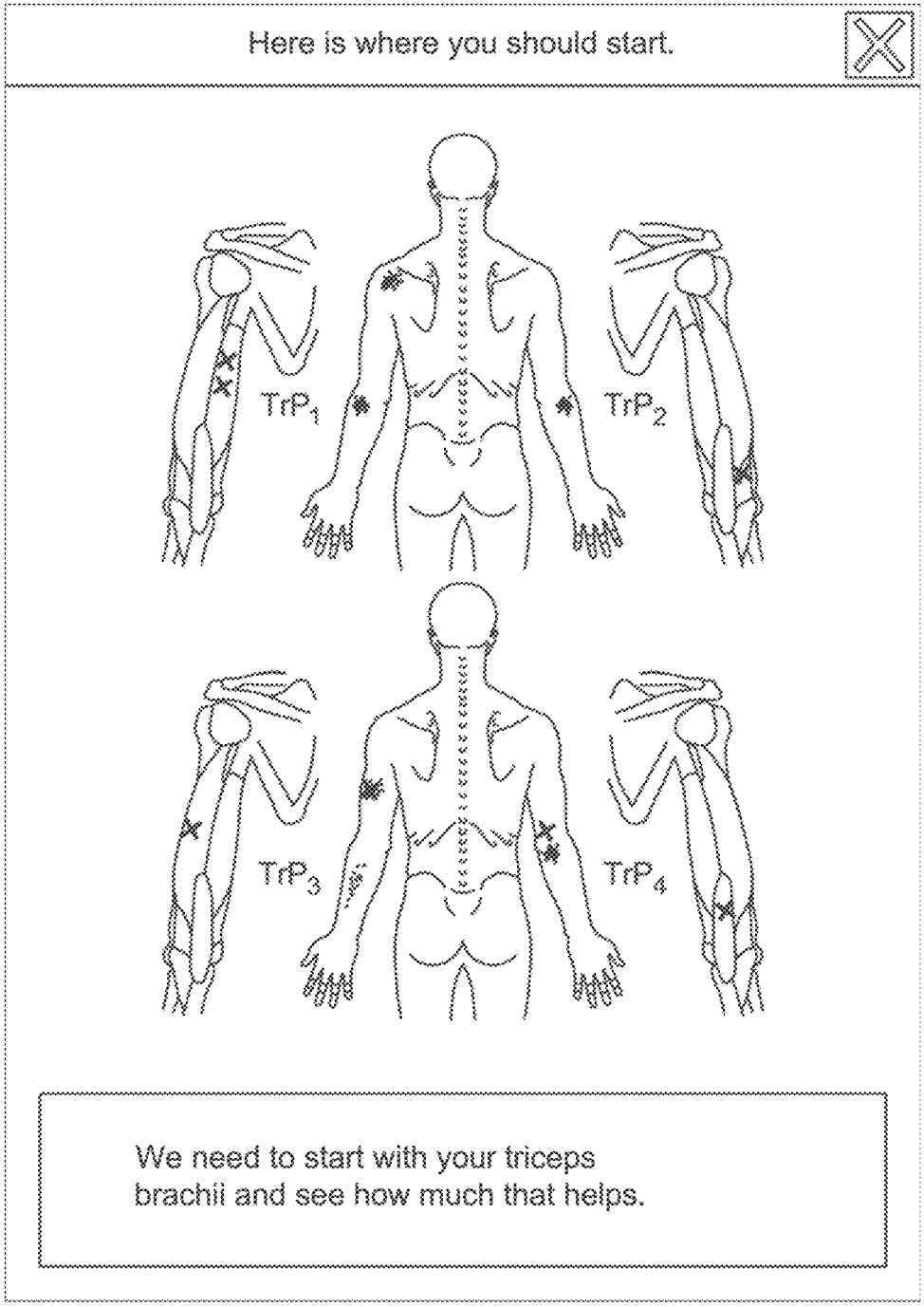

As illustrated in the embodiment of a screenshot in FIG. 18, the system can be configured to analyze data and/or information that is provided to it (e.g., via a user directly, via sensors, via a professional who directs the user to take specific steps in a therapy protocol, etc.). In some embodiments, the system can be configured to determine an appropriate therapy protocol (e.g., a massage therapy protocol, a physical therapy protocol, etc.) to guide the user in properly identifying a problem and working toward improving it (e.g., MTrP for identified conditions of pain or stress).

Figure 19:
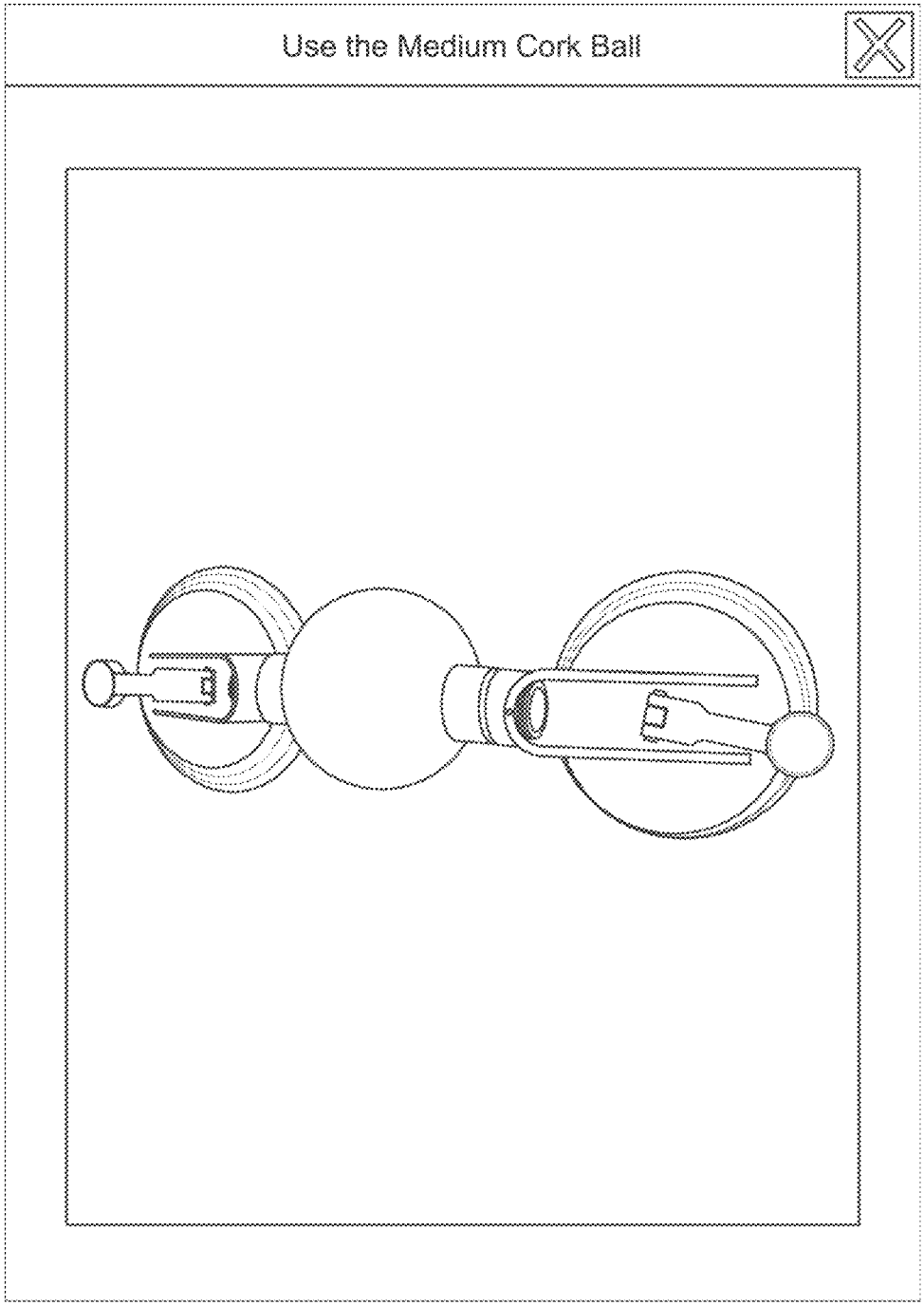

In some embodiments, the system can be configured to instruct the user to incorporate a particular device or set of devices into a therapy protocol. For example, as shown in FIG. 19, the system can instruct the user (e.g., via text and/or graphics provided in a touchscreen or other output) to use a specific massage or other therapy device. In FIG. 19, the system has identified and displayed an assembly of a mounting carriage and a specific massage device. A recommendation provided by the system can include, but is not limited to, a specific mounting carriage or other support device, a specific massage or therapy device that will make at least partial contact with the user, an orientation of the device (e.g., vertical, horizontal, diagonal relative to a wall or floor, etc.) and/or the like.

In FIG. 19, with specific reference to a recommended therapy device, the system can be configured to provide details about the therapy device's characteristics, including but not limited to, mounting position, orientation, massage device size, shape, surface material, density for treating the relevant MTrP and/or the like. Additional instructions and/or other information can also be provided to the user, such as, for example, warnings related to system use under certain preconditions, recommended time for a particular step, required preparatory steps, methods to recognize effective treatment, and/or the like.

Figure 20:
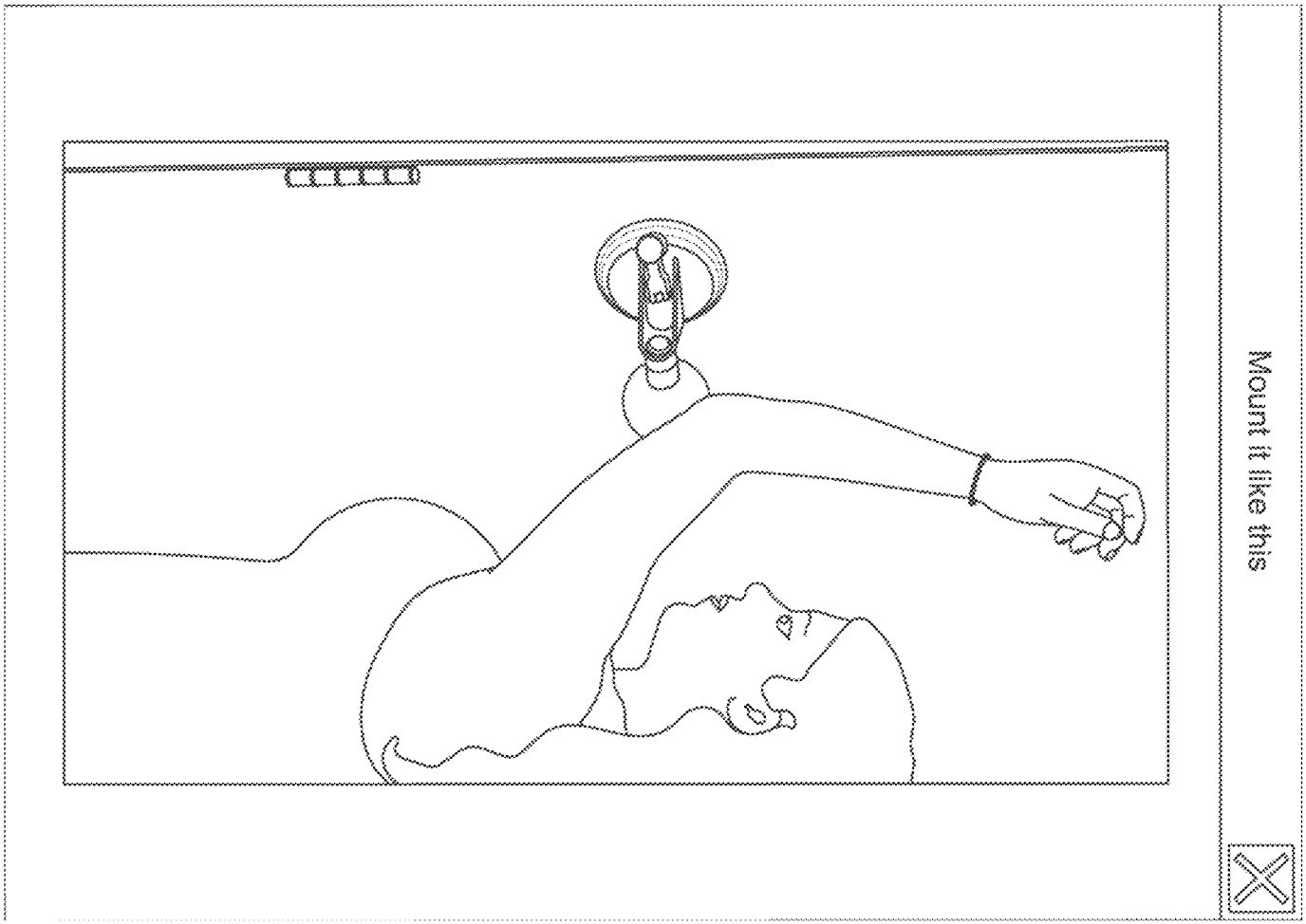
Figure 21:
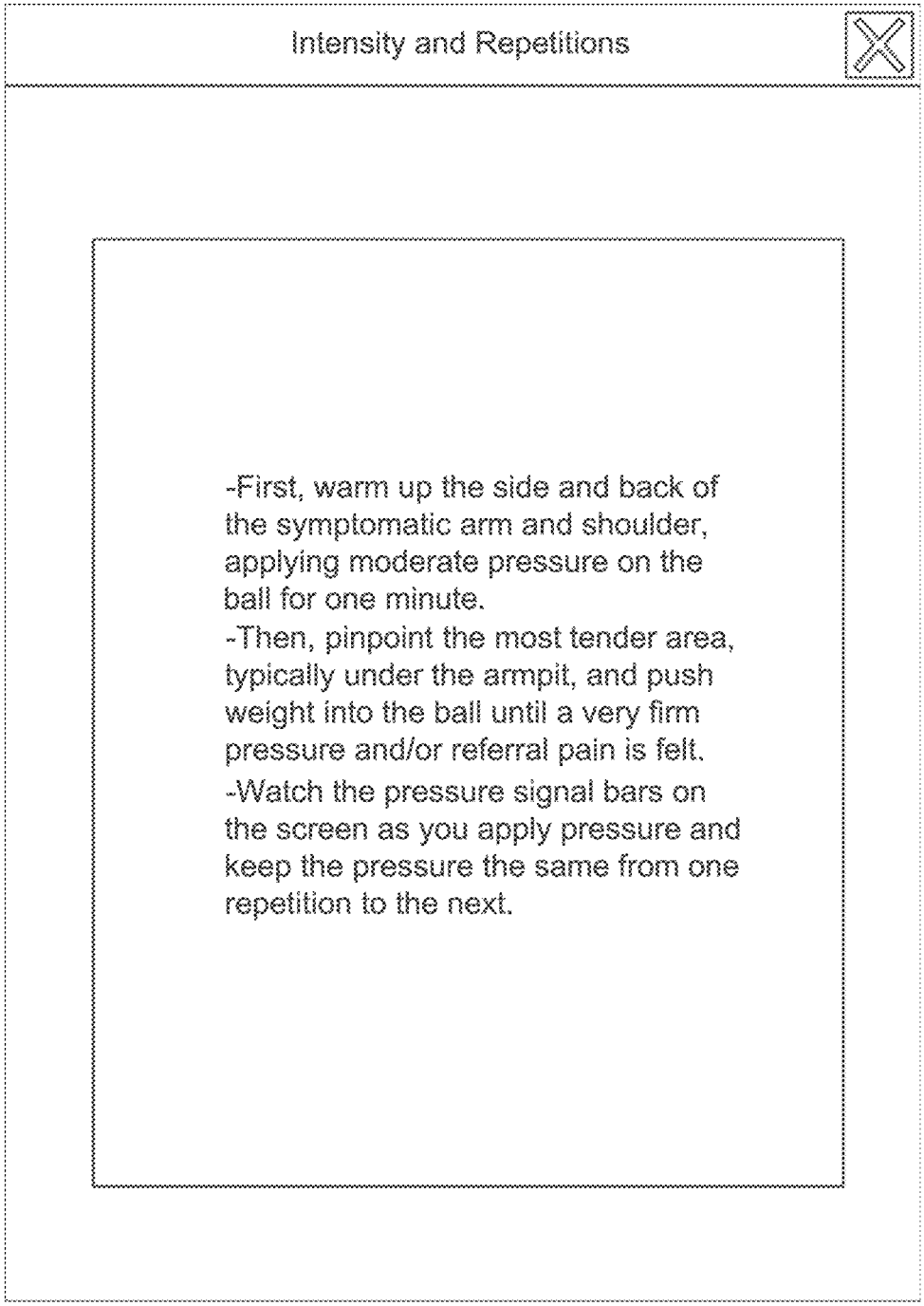
Figure 22:
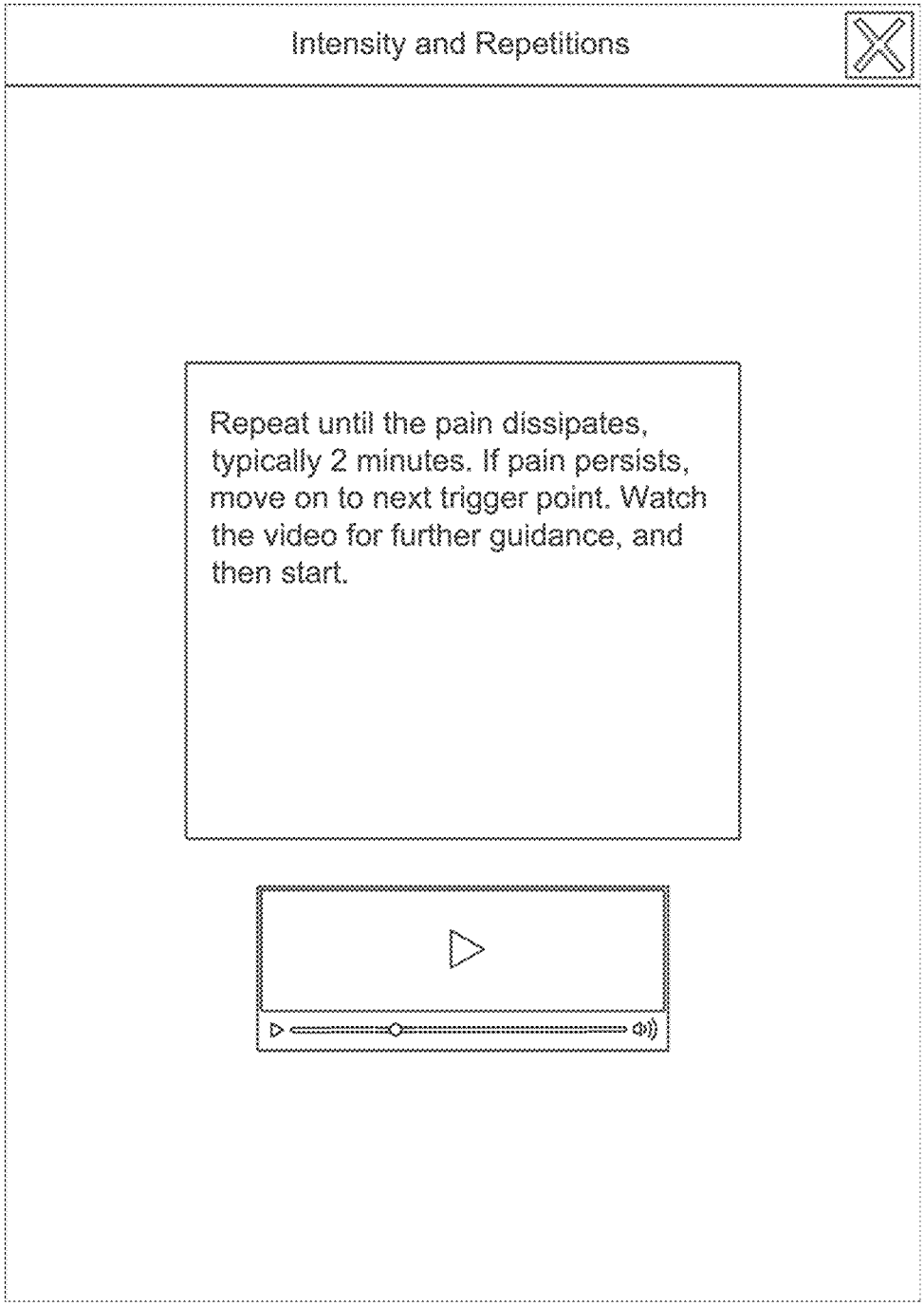

As illustrated by the embodiment of the display output of FIG. 20, the system can be configured to provide a visual reference on how to use the assembly. In some embodiments, this can include still photographs or images (e.g., that can be advanced through a series of frames or steps), videos, hybrids and/or any other visual output. As shown in FIGS. 21 and 22, the software can be configured to provide specific instruction for the correct or recommended parameters of treatment, including but not limited to, amount of pressure to apply to the body, the number of repetitions the massage movement is to be applied, the time duration of the application of the massage movement and/or the like. The system can also be adapted to provide additional method of instruction, such as a video tutorial related to proper execution of the protocol, reference to printed material, etc.

Figure 23:
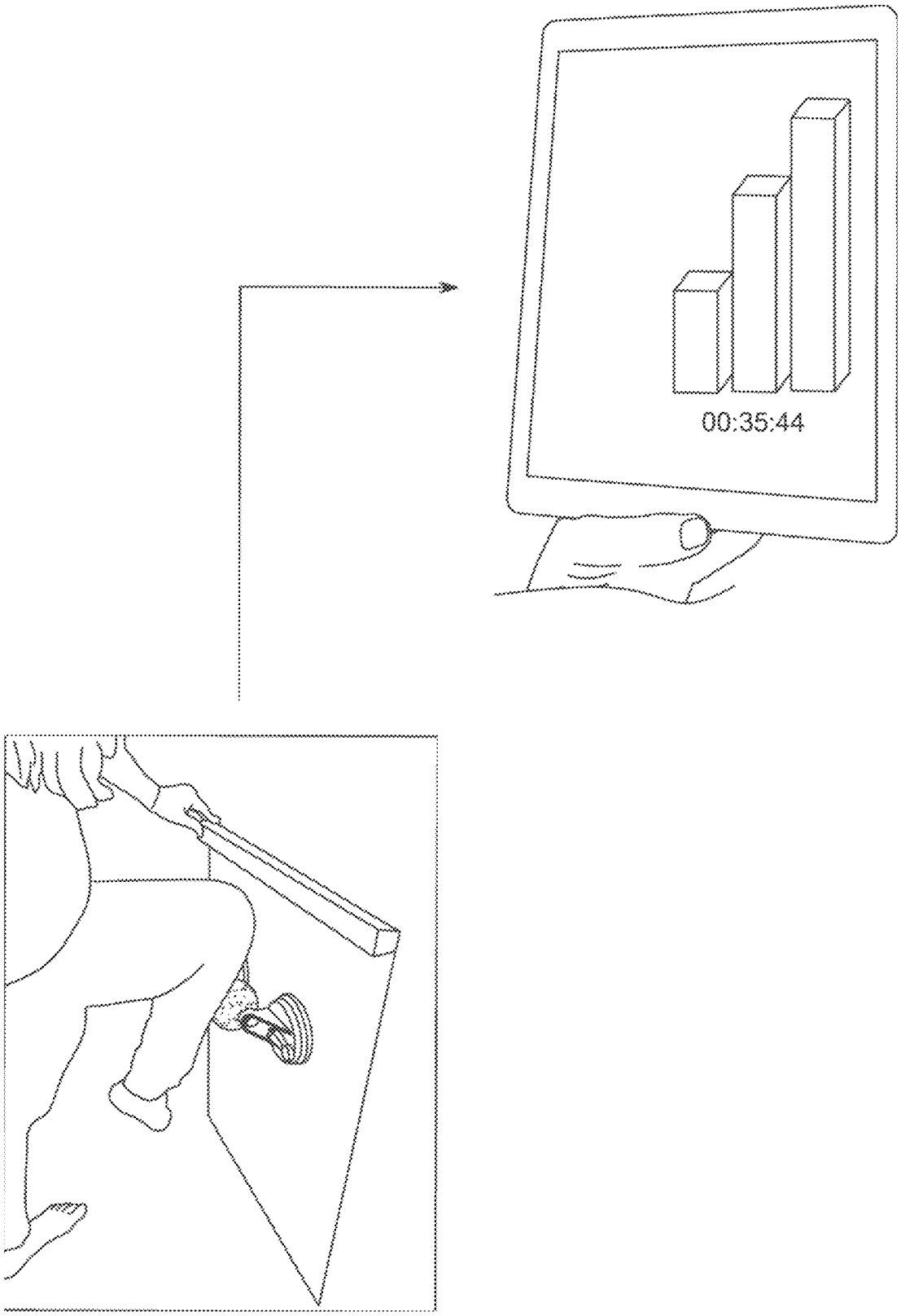
FIG. 23 illustrates a graphical representation of data being transmitted from a massage device to a processor or other component of the system.

As illustrated in FIG. 23 in some embodiments, data sent from the mounting chassis and/or any other portion of the therapy device in response to user activity is received by the processor or other system component (e.g., within a tablet, smartphone, personal computing device, etc.). The system can be configured to process these data and provide a display to the user to guide the user in correctly performing the massage therapy protocol. In some embodiments, this information can be analyzed to provide historical usage information.

The systems, apparatuses, devices and/or other articles disclosed herein may be manufactured or otherwise formed through any suitable means. The various methods and techniques described above provide a number of ways to carry out the disclosed inventions. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and steps discussed above, as well as other known equivalents for each such feature or step, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the inventions disclosed herein.

The various systems, devices and/or related methods disclosed herein can be used to provide self-administered massage therapy (or any other type of therapy) to one or more portions of a subject's anatomy, including without limitation, legs, arms, torso, hips and/or any other anatomical area or region. The selective therapy and/or other benefits and advantages provided to a subject as a result of the various inventions disclosed herein can be used to treat one or more conditions, ailments or diseases.

Although several embodiments and examples are disclosed herein, the present application extends beyond the specifically disclosed embodiments to other alternative embodiments and/or uses of the inventions and modifications and equivalents thereof. It is also contemplated that various combinations or subcombinations of the specific features and aspects of the embodiments may be made and still fall within the scope of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above, but should be determined only by a fair reading of the claims that follow.

While the embodiments disclosed herein are susceptible to various modifications, and alternative forms, specific examples thereof have been shown in the drawings and are herein described in detail. It should be understood, however, that the inventions are not to be limited to the particular forms or methods disclosed, but, to the contrary, the inventions are to cover all modifications, equivalents, and alternatives falling within the spirit and scope of the various embodiments described and the appended claims. Any methods disclosed herein need not be performed in the order recited. The methods disclosed herein include certain actions taken by a practitioner; however, they can also include any third-party instruction of those actions, either expressly or by implication. The ranges disclosed herein also encompass any and all overlap, sub-ranges, and combinations thereof. Language such as "up to," "at least," "greater than," "less than," "between," and the like includes the number recited. Numbers preceded by a term such as "about" or "approximately" include the recited numbers. For example, "about 10 mm" includes "10 mm." Terms or phrases preceded by a term such as "substantially" include the recited term or phrase. For example, "substantially parallel" includes "parallel."

What is claimed is:

1. A kit for assembling a self-administered therapy device into one of a plurality of configurations, the kit comprising:

two base members, each base member configured to be secured to a surface for mounting the therapy device to said surface;

a first shaft configured to secure to the two base members and extend between the two base members;

a second shaft configured to secure to the two base members and extend between the two base members;

wherein each of the first shaft and the second shaft comprises a unitary structure having a fixed length, and wherein the second shaft is longer than the first shaft such that a length of the therapy device is increased when the second shaft is used in place of the first shaft;

a first therapy member configured to be secured relative to the first shaft or the second shaft; and a second therapy member configured to be secured relative to the first shaft or the second shaft;

wherein each base member comprises a receiving tube portion that is shaped, sized and configured to receive an end of the first or second shaft in order to secure the first or second shaft to the base member, wherein the receiving tube portion completely surrounds the shaft at least a length of the first or second shaft;

wherein the second therapy member comprises a different length, size or shape than the first therapy member;

wherein the therapy device is adapted to be configured in a first orientation and at least a second orientation, wherein at least one of the following changes between the first orientation and the second orientation: (i) a length of the therapy device and (ii) a type of therapy member used in the therapy device;

wherein each of the two base members is configured to releasably secure to the surface; and wherein each base member is configured to releasably secure to the surface without penetrating said surface.

2. The kit of claim 1, wherein the receiving tube portion is positioned along a same longitudinal axis as the first shaft or the second shaft when the first shaft or the second shaft is secured to the at least two base member in an assembled therapy device.

3. The kit of claim 2, wherein the longitudinal axis is parallel to the surface to which the base members are configured to releasably secure.

4. The kit of claim 1, wherein each of the base members comprises a locking tab or lever, wherein movement of the locking tab or lever is configured to selectively secure the base member to the surface or release the base member from the surface.

5. The kit of claim 4, wherein the locking tab or lever is positioned along a top surface of the base member to facilitate movement of the locking tab or lever when securing the base member to a surface or releasing the base member from a surface.

6. The kit of claim 1, wherein the first therapy member comprises a circular shape, and wherein the second therapy member comprises a cylindrical shape.

7. The kit of claim 1, wherein at least a portion of the therapy device is configured to vibrate.

8. The kit of claim 1, wherein at least one sensor is positioned on or near at least one of: (i) the first shaft or the second shaft, and (ii) the first therapy member or the second therapy member.

9. The kit of claim 8, wherein the at least one sensor comprises one or more of the following: a pressure sensor, a proximity sensor, a location sensor, a strain sensor, a temperature sensor, a humidity sensor, and a motion or movement sensor.

10. The kit of claim 8, wherein data obtained from the at least one sensor is configured to be communicated to at least one processor, wherein the at least one processor is configured to process said data obtained from the at least one sensor and provide feedback to a user.

11. A kit for assembling a self-administered therapy device into one of a plurality of configurations, the kit comprising:

two base members, each base member configured to be releasably secured to a surface for mounting the therapy device to said surface, wherein each base member is configured to releasably secure to the surface without penetrating said surface;

a first shaft configured to secure to the two base members and extend between the two base members;

a second shaft configured to secure to the two base members and extend between the two base members;

wherein each of the first shaft and the second shaft comprises a fixed length, and wherein the second shaft is longer than the first shaft such that a length of the therapy device is increased when the second shaft is used in place of the first shaft;

a first therapy member configured to be secured relative to the first shaft or the second shaft; and a second therapy member configured to be secured relative to the first shaft or the second shaft;

wherein each base member comprises a receiving tube portion that is shaped, sized and configured to receive an end of the first or second shaft in order to secure the first or second shaft to the base member, wherein the receiving tube portion completely surrounds the shaft at least a length of the first or second shaft;

wherein the second therapy member comprises a different length, size or shape than the first therapy member; and wherein the therapy device is adapted to be configured in a first orientation and at least a second orientation that is different in at least one aspect than the first orientation.

12. The kit of claim 11, wherein the receiving tube portion is positioned along a same longitudinal axis as the first shaft or the second shaft when the first shaft or the second shaft is secured to the at least two base member in an assembled therapy device.

13. The kit of claim 11, wherein each of the base members comprises a locking tab or lever, wherein movement of the locking tab or lever is configured to selectively secure the base member to the surface or release the base member from the surface.

14. The kit of claim 13, wherein the locking tab or lever is positioned along a top surface of the base member to facilitate movement of the locking tab or lever when securing the base member to a surface or releasing the base member from a surface.

15. The kit of claim 11, wherein the first therapy member comprises a circular shape, and wherein the second therapy member comprises a cylindrical shape.

16. The kit of claim 11, wherein at least one sensor is positioned on or near at least one of: (i) the first shaft or the second shaft, and (ii) the first therapy member or the second therapy member, wherein the at least one sensor comprises one or more of the following: a pressure sensor, a proximity sensor, a location sensor, a strain sensor, a temperature sensor, a humidity sensor, and a motion or movement sensor.

17. The kit of claim 16, wherein data obtained from the at least one sensor is configured to be communicated to at least one processor, wherein the at least one processor is configured to process said data obtained from the at least one sensor and provide feedback to a user.

18. The kit of claim 12, wherein the longitudinal axis is parallel to the surface to which the base member are configured to releasably secure.

19. The kit of claim 11, wherein at least a portion of the therapy device is configured to vibrate.

* * * * *